US012604963B2

(12) United States Patent
Lotti

(10) Patent No.: US 12,604,963 B2
(45) Date of Patent: Apr. 21, 2026

(54) NAIL FORMS AND NAIL SYSTEMS AND METHODS

(71) Applicant: Brilliance of Beauty, Inc., New York, NY (US)

(72) Inventor: Sahara Lotti, North Hollywood, CA (US)

(73) Assignee: Brilliance of Beauty, Inc., North Hollywood (CA)

( * ) Notice: Subject to any disclaimer, the term of this patent is extended or adjusted under 35 U.S.C. 154(b) by 0 days.

(21) Appl. No.: 18/772,019

(22) Filed: Jul. 12, 2024

(65) Prior Publication Data

US 2025/0017351 A1 Jan. 16, 2025

Related U.S. Application Data

(60) Provisional application No. 63/513,423, filed on Jul. 13, 2023.

(51) Int. Cl.
*A45D 31/00* (2006.01)

(52) U.S. Cl.
CPC ..... *A45D 31/00* (2013.01)

(58) Field of Classification Search
CPC ..... A45D 29/18; A45D 29/20; A45D 29/00; A45D 29/06; A45D 29/004; A45D 29/001; A45D 2034/002; A45D 31/00; A45D 2029/005; A45D 2029/008
See application file for complete search history.

(56) References Cited

U.S. PATENT DOCUMENTS

| | | | | |
|---|---|---|---|---|
| 2,580,739 | A * | 1/1952 | Delno | A45D 29/004 132/73 |
| 3,157,912 | A * | 11/1964 | Lisczawka | A61Q 3/00 249/55 |
| 4,625,740 | A | 12/1986 | Roth | |
| 4,643,208 | A | 2/1987 | Amour | |
| D295,451 | S | 4/1988 | Mast | |
| 7,185,660 | B1 | 3/2007 | Han | |
| D545,495 | S | 6/2007 | Ma et al. | |
| 7,506,652 | B2 | 3/2009 | Fracassi et al. | |

(Continued)

FOREIGN PATENT DOCUMENTS

| | | | |
|---|---|---|---|
| CR | 9387 | U * | 10/2007 |
| JP | 2003210242 | A | 7/2003 |

OTHER PUBLICATIONS

Vnjaoi, 120 Pcs Poly Extension Gel Dual Nail forms, https://a.co/d/8NU9V7L, Amazon (Year: 2023).*

(Continued)

*Primary Examiner* — Edelmira Bosques
*Assistant Examiner* — Sarah Woodhouse
(74) *Attorney, Agent, or Firm* — Lowenstein Sandler LLP

(57) ABSTRACT

A nail form for applying a nail coating includes a body having a top surface and a bottom surface opposite the top surface. The bottom surface has a first curvature forming a cavity in a shape of a natural nail. The body includes a first lateral side and a second lateral side. The top surface and the bottom surface extend between the first lateral side and the second lateral side. The nail form includes a first side member that extends outwardly from the top surface proximate the first lateral side and a second side member that outwardly from the top surface proximate the second lateral side.

18 Claims, 13 Drawing Sheets

(56) References Cited

U.S. PATENT DOCUMENTS

| | | | | |
|---|---|---|---|---|
| 8,210,185 | B2 | 7/2012 | Fracassi et al. | |
| D692,888 | S | 11/2013 | Moore | |
| 9,924,774 | B2 | 3/2018 | Kim et al. | |
| D987,188 | S | 5/2023 | Wang | |
| 2004/0079381 | A1 | 4/2004 | Han | |
| 2011/0114106 | A1* | 5/2011 | Munoz | A45D 31/00 132/73 |
| 2011/0308539 | A1 | 12/2011 | Chung et al. | |
| 2013/0333717 | A1* | 12/2013 | Lee | A45D 29/00 132/285 |
| 2017/0188688 | A1* | 7/2017 | Samain | A61K 8/927 |
| 2021/0315360 | A1 | 10/2021 | Ma | |
| 2022/0133013 | A1 | 5/2022 | Lotti | |
| 2024/0122329 | A1 | 4/2024 | Deng | |
| 2025/0241424 | A1 | 7/2025 | Um et al. | |

OTHER PUBLICATIONS

DeEnti, "Temperature Changes and the Effect on Acrylic Nails", https://www.deenterprises.com/blog/temperature-effect-acrylic-nails/#:~:text=Every%20degree%20of%20variance%20from,the%20quicker%20they%20will%20cure., Nov. 1, 2019 (Year: 2019).*

Clarivate Analytics copyrighted translation of KR102448553B1 (Year: 2022).*

Clarivate Analytics copyrighted translation of CN117794490A (Year: 2024).*

Clarivate Analytics copyrighted translation of DE102009007935A1 (Year: 2009).*

Clarivate Analytics copyrighted translation of DE3642534A (Year: 1988).*

Clarivate Analytics copyrighted translation of DK201600170A1 (Year: 2017).*

Clarivate Analytics copyrighted translation of EP2724639A1 (Year: 2014).*

Clarivate Analytics copyrighted translation of ES2608705A1 (Year: 2017).*

Clarivate Analytics copyrighted translation of KR102188137B1 (Year: 2020).*

Clarivate Analytics coyrighted translation of KR102188139B1 (Year: 2020).*

Clarivate Analytics copyrighted translation of KR102281177B1 (Year: 2020).*

International Search Report and Written Opinion for International Application No. PCT/US2024/038076, mailed Dec. 20, 2024, 23 Pages.

* cited by examiner

NAIL FORMS AND NAIL SYSTEMS AND METHODS

RELATED APPLICATIONS

This application claims the benefit of Provisional Application No. 63/513,423, filed Jul. 13, 2023, the entire content of which are incorporated by reference herein.

FIELD OF TECHNOLOGY

The present disclosure relates generally to artificial nails, an in particular to nail forms for the application of artificial nails.

BACKGROUND

Consumers wear artificial nails and nail coatings over their natural nails for both cosmetic and protective reasons. Highly skilled professional manicurists and pedicurists are trained in various techniques of nail care and design. These professionals pay close attention to detail to ensure client comfort, health, and beauty. Their work demands precision, perfection, and the use of high-quality products.

SUMMARY

According to some embodiments, disclosed herein is a nail form for applying a nail coating comprising: a body comprising: a top surface; a bottom surface opposite the top surface, the bottom surface having a first curvature forming a cavity in a shape of a natural nail; a first lateral side; and a second lateral side, wherein the top surface and the bottom surface extend between the first lateral side and the second lateral side; a first side member that extends outwardly from the top surface proximate the first lateral side; and a second side member that extends outwardly from the top surface proximate the second lateral side.

In some embodiments, the first side member and the second side member extend outwardly at an angle with respect to the top surface. In some embodiments, the first side member and the second side member are configured to push nail folds of a subject away from the natural nail of the subject at an application of the nail form.

In some embodiments, the nail form further comprises: a rear member protruding from a rear portion of the first lateral side and the second lateral side. In some embodiments, a thickness of the rear member is different than a thickness of the rear portion of the first lateral side and the second lateral side. In some embodiments, an interior surface of the rear member has a second curvature. In some embodiments, the rear member is configured to displace a cuticle of a subject at an application of the nail form.

In some embodiments, the nail form further comprises: a guide feature located at the bottom surface to promote a nail coating coupled to the bottom surface to distribute towards an apex of the first curvature of the bottom surface. In some embodiments, the guide feature comprises a flange that extends inwardly. In some embodiments, the guide feature comprises the first curvature of the bottom surface. In some embodiments, the first curvature of the bottom surface is curved such that a vector normal to a first portion of the bottom surface proximate the first lateral side points at a second portion of the bottom surface opposite the first portion.

In some embodiments, the nail form further comprises: a nail coating removably attached to the bottom surface. In some embodiments, the nail coating is a pre-applied nail coating that is pre-applied at manufacture to form a prefilled nail form. In some embodiments, the nail coating comprises a light-curable nail coating. In some embodiments, light-curable nail coating comprises a semi-cured material prior to an application of the nail form. In some embodiments, the nail coating comprises at least one of a polish, gel, polygel, acrylic gel, and polymer composition.

In some embodiments, the nail form further comprises: a non-stick coating disposed on the bottom surface.

In some embodiments, the nail form further comprises: a marking visible at the top surface, the marking identifying a size of the nail form.

In some embodiments, the first curvature of the bottom surface is along a first axis, the bottom surface having a third curvature along a second axis, the first curvature and the third curvature forming the cavity in the shape of the natural nail.

In some embodiments, the body of the nail form is formed of a material that is transparent or semi-transparent.

According to some embodiments, disclosed herein is a nail kit comprising: a plurality of prefilled nail forms, each prefilled nail form comprising: a body comprising: a top surface; a bottom surface opposite the top surface, the bottom surface having a first curvature forming a cavity in a shape of a natural nail; a first lateral side; and a second lateral side, wherein the top surface and the bottom surface extend between the first lateral side and the second lateral side; a nail coating that is pre-applied to the bottom surface of the body of each of the plurality of prefilled nail forms; and a container to store the plurality of prefilled nail forms.

In some embodiments, the nail kit further comprises: a first side member that extends outwardly from the top surface proximate the first lateral side; and a second side member that extends outwardly from the top surface proximate the second lateral side.

In some embodiments, the plurality of prefilled nail forms comprise different sized prefilled nail forms. In some embodiments, the nail coating comprises a material in a semi-cured state.

According to some embodiments, disclosed herein a nail system comprising: a plurality of nail forms, each nail form including: a plurality of side members, each side member located on a side of the nail form; and a rear member located at a rear of the nail form; a nail coating; a light source; and a pressure source.

According to some embodiments, disclosed herein is a method of applying a nail coating comprising: placing a nail form with a nail coating onto a natural nail; arranging side members and a rear member of the nail form to contact the skin located proximate to the natural nail; and shaping the nail form on the nail in a desired placement responsive to the placement of the side members and the rear member.

In some embodiments, the method comprises: displacing a cuticle on the nail with the rear member. In some embodiments, the method further comprises applying the nail coating to an underside of the nail form. In some embodiments, the method further comprises curing the nail coating on the nail. In some embodiments, the method further comprises applying pressure to the nail form and nail coating with a pressure device.

According to some embodiments, disclosed herein is a method of manufacturing a nail form comprising: forming a nail form; forming a side member on a top surface of the nail form; and forming a rear member on an end of the nail form.

In some embodiments, the method further comprises forming a cavity in a bottom side of the nail form to receive a nail coating. In some embodiments, the method further comprises forming desired design attributes in the nail form. In some embodiments, the method further comprises shaping the cavity for predetermined features for the nail coating.

In some embodiments, the cavity is shaped for a desired apex in the nail coating. In some embodiments, the method further comprises molding the nail coating with a desired apex in the cavity. In some embodiments, the method further comprises applying a nail coating in the cavity of the nail form. In some embodiments, the method further comprises assembling the nail form and the nail coating in a kit.

In some embodiments, the method further comprises shaping the nail form in at least one of a round, almond, squoval, coffin, oval, square, and stiletto shape. In some embodiments, the method further comprises molding a nail coating in the nail form in at least one of a round, almond, squoval, coffin, oval, square, and stiletto shape.

According to some embodiments, disclosed herein is a device for curing a nail coating onto a natural nail during a nail coating application with a nail form, comprising: a housing; a light source; and a pressure source to apply pressure to the nail form during the nail coating application.

In some embodiments, the device further comprises a platform in the housing to receive a user's finger. In some embodiments, at least one of the light source and pressure source are configured to automatically power on responsive to user operation.

BRIEF DESCRIPTION OF THE DRAWING

Aspects and embodiments of the disclosure will be understood more fully from the detailed description given below and from the accompanying drawings of various aspects and embodiments of the disclosure, which, however, should not be taken to limit the disclosure to the specific aspects or embodiments, but are for explanation and understanding.

DETAILED DESCRIPTION

Figure 1:
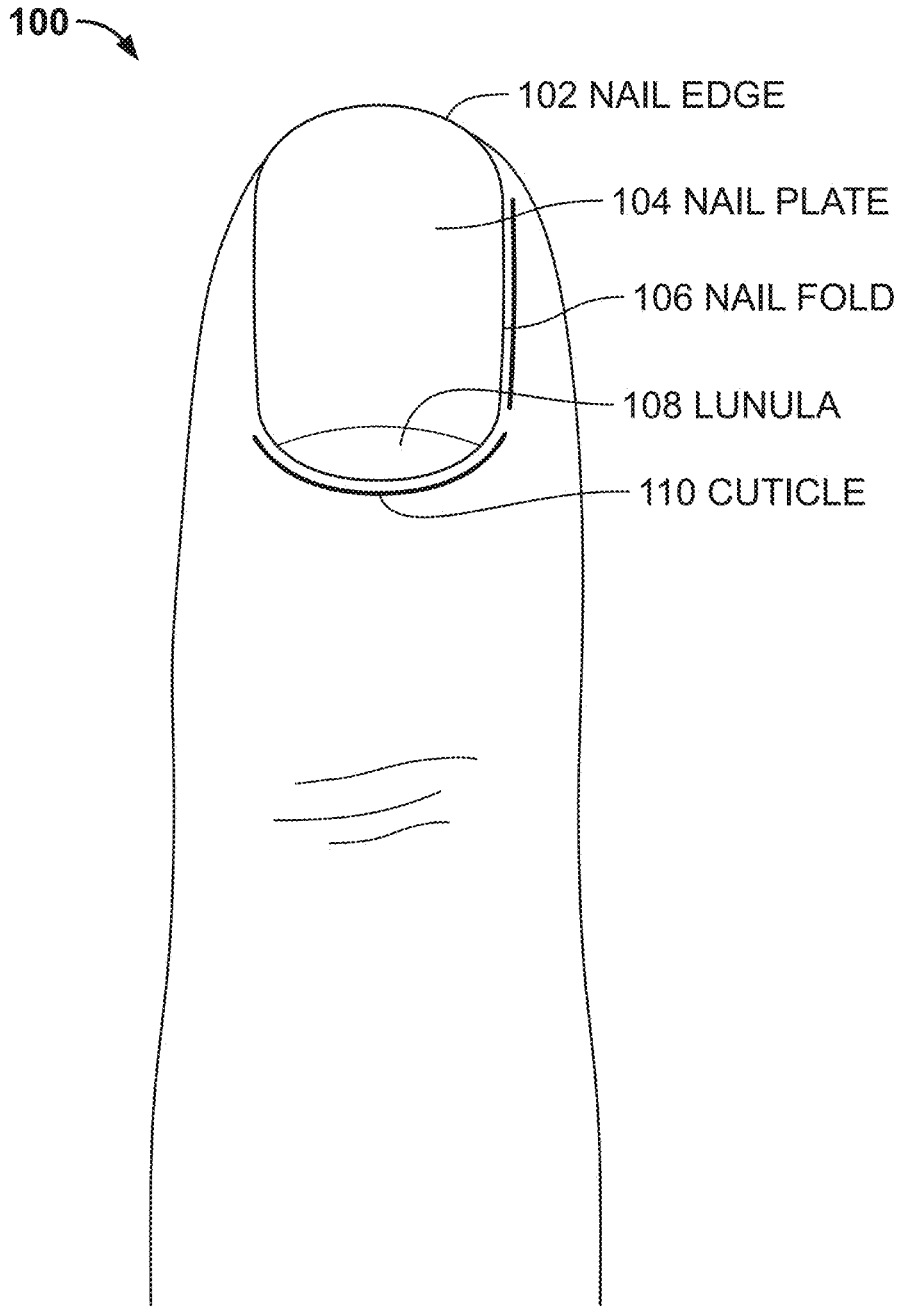
FIG. 1 illustrates a natural nail, in accordance with some embodiments of the disclosure.

A manicure can refer to a cosmetic beauty treatment for the hands and fingernails. A manicure can refer to a cosmetic beauty treatment for the feet and toenails. A manicure (and/or pedicure) can be a meticulous process that calls for skill, time, and attention to detail from a professional nail technician. The process can begin with soaking and cleaning the hands to soften the skin and nails. Next, the technician carefully pushes back and trims the cuticles, followed by shaping and filing the nails to the desired length and style. Exfoliation of the hands may be performed to remove dead skin cells, leaving the skin smooth. Moisturization follows, ensuring the hands and cuticles are hydrated.

The application of nail coatings is an important step. For traditional polish, the process starts with a base coat to protect the nails and enhance the adhesion of the polish. The application of the base coat is followed by one or more layers of colored nail polish, often chosen by the client, and finally a top coat to seal and protect the color, adding a glossy finish. For gel nails, the process involves applying a base gel layer, which can be cured under an ultraviolet (UV) or light-emitting diode (LED) lamp to cure the gel. The curing of the base gel layer is followed by the application of gel color in layers, with each layer being cured under the UV lamp. A top gel coat can be applied and cured to seal the color and add shine. Gel nails are particularly popular for their durability and chip-resistant qualities.

Depending on the complexity of the nail design or any additional nail art, a standard manicure can take a significant amount of time, while gel manicures might take even longer due to the curing process. The cost for manicures can be high. The skill of the nail technician is paramount to ensure a flawless application and long-lasting results, and to prevent damage to the natural nails.

Alternatives to a manicure (and/or pedicure) by a nail technician include do it yourself (DIY) at-home manicures and using press-on nails. While these options may be cost-effective and convenient, the options often lack the precision and thoroughness of a professional manicure. At-home manicures can result in uneven nail shaping (e.g., without clean, straight, and/or smooth edging around the nail), improper cuticle care, lines of nail coatings that are not straight at the edges and/or the cuticle (e.g., uneven edges), nail coatings unevenly spread (e.g., streaking), nail coatings on the cuticle, and a shorter-lasting polish application. Press-on nails, although quick to apply, often do not fit perfectly, can fall off easily, and often do not provide the same natural look and durability as professionally applied nail coatings. Additionally, the lack of professional tools and expertise can lead to less satisfactory results and potential nail and skin damage.

Aspects of the disclosure address the above challenges as well as others by using a nail form for the application of a nail coating (e.g., artificial nails) where the use of the nail form (also referred to as "dual form" or "nail mold" herein) provides a professional-level manicure (or pedicure) in less time than a professional manicure and without requiring a trained nail technician. The nail form can include a bottom surface having one or more curvatures that define a cavity in the body of the nail form. A nail coating can be disposed in the cavity, and the nail coating can be applied to the natural nail by applying the nail form to the natural nail.

In some embodiments, the nail form can have one or more features that promote the application of the nail coating in a manner that provides a professional-level manicure or pedicure. In some embodiments, the rear member can extend from the rear portion of the body. The rear member can be a curved thin element that is designed to push back the cuticle and expose the respective portion of the nail plate for the application of the nail coating and prevent leakage of the nail coating onto the cuticle-which adds to a professional-level manicure (e.g., clean lines completely covering the natural nail with no blemishes or exposed natural nail).

In some embodiments, the nail form can include one or more side members that protrude from both sides of the top surface of the body of the nail form at an angle. The side members can be configured to push away the respective lateral nail folds (and/or portions of cuticle) to expose the nail plate at the side edges of the natural nail. The additional exposed nail plate allows for additional surface area of the nail plate to be covered with the nail coating and prevents the subject's skin, such as the lateral nail folds from being covered with nail coating-which also adds to a professional-level manicure. The side members can also apply pressure to the adjacent skin to help secure the nail form on the natural nail and prevent the nail form from lifting prematurely.

In some embodiments, the nail form includes a guide feature that promotes the nail coating to remain within the cavity of the body of the nail form during the application of the nail form (e.g. prevents the nail coating from leaking out at application of the nail form). For example, pressure can be applied to a filled nail form (e.g., filled with a nail coating) to secure the nail form and nail coating to the natural nail. In some embodiments, the guide feature can promote the nail coating to be pushed upwards towards the apex of the cavity rather than leak outside the body. In some embodiments, the guide feature can include an inwardly facing flange around the permitter of the cavity. In some embodiments, the curvatures of the bottom surface and that form the cavity can be designed to promote the nail coating to travel towards the apex of the cavity responsive to the application of pressure.

In some embodiments, the curvatures (of the bottom surface) that form the cavity can be designed to promote an asymmetric distribution of the nail coating on the natural nail. For example, and in some embodiments, the curvatures of the bottom surface can cause more nail coating to be disposed at and around the apex of the cavity than at the edges of nail form (and the edges of the natural nail). Such asymmetric thickness of the nail coating can strengthen or reinforce the natural nail when applied with respect to the stress point of the natural nail. In some cases, the asymmetric thickness can contribute to the aesthetic of the manicure.

In some embodiments, the nail form can be filled by the subject immediately prior to application on the natural nail. In some embodiments, the nail form can be a prefilled nail form where the nail coating is pre-applied to the nail form at manufacturing (e.g., before sale). In some embodiments, the prefilled nail form can include a nail coating that is at least in part semi-cured. The nail coating can be fully cured after the prefilled nail form is attached to the natural nail. In some embodiments, the nail form can be transparent or semi-transparent to allow the transmission of light through the nail form to cure the semi-cured material (to a cured state).

In some embodiments, the nail form can be used as a single-step DIY manicure. For example, and in some embodiments, the sections of the nail coating can include or be an artificial nail with one or more various sections. The nail form can be applied pushing the cuticle away from the nail form, the nail coating contained therein is attached to the natural nail (e.g., using one or more of heat, light, air, or pressure), and the nail form is removed leaving the professional-level DIY manicured artificial nail.

It can be noted that the technology described herein may be used as a DIY system or in professional settings. The nail form described herein can be used to apply nail coating(s) to the natural nails of the hands and/or toes.

FIG. 1 illustrates a natural nail, in accordance with some embodiments of the disclosure. Components of natural nail 100 on a human finger are illustrated. The anatomy of a natural nail 100 (also referred to as "nail" herein) includes many components. Each component can serve a specific function. The nail edge 102 can refer to the distal end of the nail plate 104 that can extend beyond the fingertip. The nail edge can be the part of the natural nail 100 that is most often trimmed or filed during grooming. The nail plate 104 can refer to the hard and keratinous surface of the natural nail 100. The nail plate 104 sits above the nail bed and serves as a protective barrier for the sensitive tissues underneath.

The nail fold 106 (also referred to as "lateral nail fold" herein) can refer to skin that frames sides of the nail plate. The nail fold can also include skin that frames the base of the nail plate 104 (e.g., proximal nail fold). The lateral nail fold can protect the sides of the nail plate 104 and the underlying nail bed from physical trauma and environmental exposure to help prevent injuries and infections that can damage the natural nail 100 or surrounding tissue. The lateral nail fold can provide structural support for the nail plate 104 and can provide a barrier to pathogens. It can be appreciated that a lateral nail fold can be present at both lateral sides of the nail plate 104. The proximal nail fold can protect the emerging natural nail as it grows from the matrix. The cuticle 110 can extend from the proximal nail fold toward the nail edge 102.

The lunula 108 can refer to a visible part of the nail matrix and can appear as a crescent-shaped, whitish area at the base of the nail plate 104. The lunula structure can aid in producing new cells that make up the nail plate 104. The cuticle 110 can include a thin layer of dead skin cells that overlaps the nail plate 104 near or at the proximal nail fold (and/or lateral nail fold). The cuticle 110 can protect the new keratin cells as they form at the base of the natural nail 100, preventing bacteria and other pathogens from entering the matrix area.

Figure 2A:
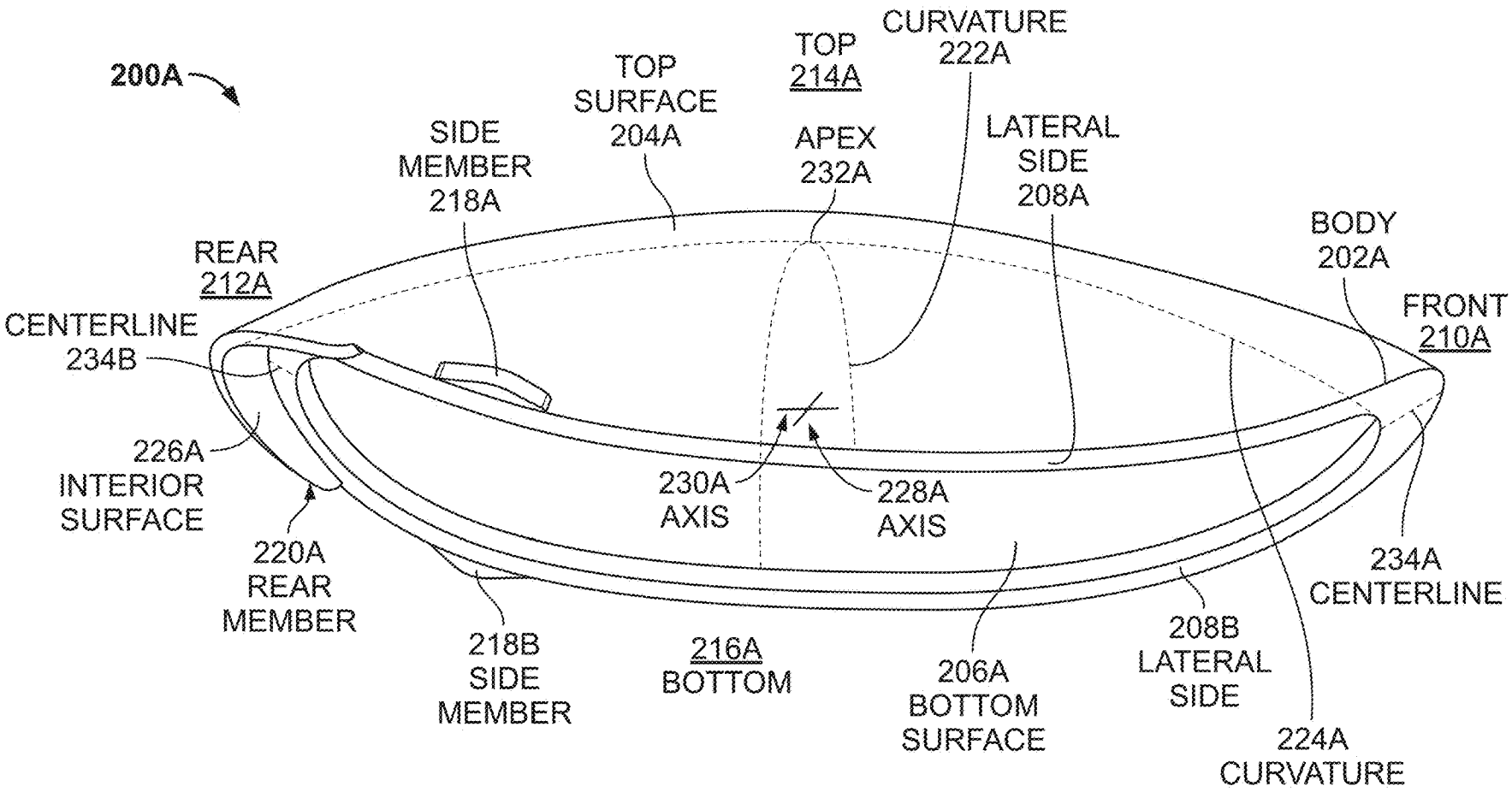
FIG. 2A illustrates a side perspective view of a nail form, in accordance with some embodiments of the disclosure.

FIG. 2A illustrates a side perspective view of a nail form, in accordance with some embodiments of the disclosure. Nail form 200A (generally referred to as "nail form 200" herein) illustrates a nail form of a first type (e.g. type A). Nail form 200A can include a top 214A (generally referred to as "top 214" herein), a bottom 216A (generally referred to as "bottom 216" herein), a front 210A (generally referred to as "front 210" herein), and a rear 212A (generally referred to as "rear 212" herein). Nail form 200A can also include a right half and left half that extend downward to the bottom 216A from curvature 224A extending between the front 210A and rear 212A of the nail form 200A.

In some embodiments, the nail form 200A can include a body 202A (generally referred to as "body 202" herein) having components as illustrated and described herein. It can be noted that for the sake of illustration, rather than limitation, the body 202A can include all the components as described and/or illustrated but for side member 218A, side member 218B and rear member 220A (generally referred to as "side member(s) 218" and "rear member 220" herein, respectively) that all extend from the body 202A, in accordance with some embodiments. In other embodiments, the body 202A can include one or more of side member 218A, side member 218B, or rear member 220A.

In some embodiments, the body 202A can include a top surface 204A (generally referred to as "top surface 204" herein) and a bottom surface 206A (generally referred to as "bottom surface 206" herein) positioned opposite the top surface 204A. In some embodiments, the bottom surface 206A can include one or more curvatures, such as curvature 224A that forms a cavity in a shape, such as in a shape of a natural nail.

In some embodiments, body 202A can include lateral side 208A and lateral side 208B (generally referred to as "lateral side(s) 208" herein). In some embodiments, the top surface 204A and bottom surface 206A extend between lateral side 208A and lateral side 208B. As illustrated, the lateral side 208A and lateral side 208B have a thickness. For the sake of illustration, rather than limitation, the lateral side 208A and lateral side 208B can extend between the centerline 234A at the front 210A and centerline 234B at the rear 212A. Centerline 234A and centerline 234B (generally referred to as "centerline 234" herein) can refer to the same centerline but at different locations of the nail form 200A.

In some embodiments, nail form 200A can include one or more side members, such as side member 218A and side member 218B (generally referred to as "side member(s) 218" herein). Side member 218A extends outwardly from the top surface 204A proximate lateral side 208A. Side member 218A extends outwardly from the top surface 204A proximate lateral side 208B. Side member 218A is located at the right half of nail form 200A and side member 218B is located at the left half of nail form 200A. In some embodiments, the side member 218A and side member 218B can be designed to push a subject's skin, such as a subject's nail folds (e.g., lateral nail folds, such as the right and left lateral nail folds) away from the natural nail of the subject during the application of nail form 200A. The side member 218A and side member 218B can expose the portions of the nail plate that are otherwise covered or protected by the nail folds. The additional exposed portions of the nail plate can enhance the application of a nail coating. It can be noted that in instances where a portion of the cuticle is adjacent to a side member 218, the side members 218 are also configured to push back the adjacent cuticle.

For example and in some embodiments, pushing back the lateral nail folds can provide improved access to the nail plate that facilitates the application of a nail coating and contributes to a polished, professional look. The pushing back of the lateral nail folds can ensure that the nail coating is not applied on the nail folds and/or that the nail coating covers the lateral sides of the nail plate without leaving an area of the lateral sides of the nail plate exposed without nail coating. It can be noted that as the nail form 200A is removed from the natural nail, the nail folds can return to an original state and abut and/or cover the edge of the nail coating, which adds to the polished and professional look of the manicure.

In some embodiments, the side members 218 can stabilize and/or hold the nail form 200A in place on the natural nail. The side members 218 can push against the subject's skin (e.g., respective lateral nail folds) to secure the nail form 200A and help hold the nail form 200A on the natural nail.

In some embodiments, side member 218A and side member 218B extend at an angle with respect to top surface 204A. In some embodiments, the side members 218 may extend substantially perpendicular (+5 degrees) from the top surface 204A (e.g., with respect to a tangent line). In some embodiments, the side members 218 may extend greater than 90 degrees from the top surface 204A and extend downwardly towards the bottom 216A. In some embodiments, the side members 218 may extend less than 90 degrees from the top surface 204A and extend upwardly towards the top 214A. In some embodiments, the side members 218 may be approximately 0.5 millimeters (mm) to 13 mm long.

In some embodiments, the nail form 200A includes a rear member 220A (generally referred to as "rear member 220" herein). In some embodiments, the rear member 220A protrudes from the rear portion of the lateral side 208A and rear portion of lateral side 208A. In some embodiments, the thickness of the rear member 220A is different than the thickness of the rear portion of one or more of lateral side 208A and lateral side 208B. In some embodiments, the rear member 220A is thinner than the rear portion of lateral side 208A and lateral side 208B. For example and as illustrated, the lateral side 208A and lateral side 208B at the rear 212A of the nail form 200A extend inwardly from the base of the rear member 220A. In some embodiments, the inner surface 226A of the rear member 220A has a curvature, such as a concave curvature. In some embodiments, the outer surface of the rear member 220A has a curvature, such as a convex curvature. In some embodiments, outer surface of the rear member 220A is flush with the top surface 204A of the body 202A. In some embodiments, the outer surface of the rear member 220A is offset from the top surface 204A of the body 202A. In some embodiment, the rear member 220A tapers from the centerline 234A towards one or both sides of the rear member 220A.

In some embodiments, the rear member 220A is configured to displace the subject's skin, such as the subject's cuticle during the application of the nail form 200A at the natural nail. In some embodiments, the rear member 220A can push the cuticle from the adjacent nail plate to expose the portion of the nail plate under the cuticle. For example, as the subject presses downwardly to attach the nail form 200A to the natural nail, the rear member 220A can push the cuticle away from the nail form. In some embodiments, the rear member 220A can remove the cuticle from the part of the nail plate where the nail coating will be attached.

For example and in some embodiments, pushing back the cuticle can expose more of the nail plate, which facilitates the application of a nail coating and contributes to a polished, professional look. The pushing back of the cuticle can ensure that the nail coating is not applied on the cuticle and that the nail coating covers the base area of the nail plate without leaving a base area of the nail plate exposed without nail coating. Pushing back the cuticle can also provide a clean and even surface for the application of nail coating and maintains a neat and healthy look for both the nails and the surrounding skin, contributing to the overall effectiveness and aesthetics of the manicure.

In some embodiments, the rear member 220A may extend from the portion of the lateral sides 208 at approximately a 25-80 degree angle. In some embodiments, the rear member 220A may be approximately 0.3 mm to 5 mm long.

In some embodiments, the bottom surface 206A can have a cavity in the shape of a natural nail. In some embodiments, the bottom surface 206A can have a curvature 222A along a first axis, such as axis 228A. The curvature 222A can have an apex, such as apex 232A. In some embodiments, the bottom surface 206A can have a curvature 224A along another axis, such as axis 230A. In some embodiment, curvature 224A also has an apex, such as apex 232A. In some embodiments, the apex for curvature 222A and curvature 224 are the same. In some embodiments, one or more of curvature 222A and curvature 224A can be concave. In some embodiments, axis 228A and axis 230A are orthogonal. In some embodiments and for the sake of illustration, curvature 222A can align with centerline 234. In some embodiments, the apex 232A can also be the apex of the bottom surface 206A. In some embodiments, the apex 232A can also be the apex of the cavity.

In some embodiments, the bottom surface 206A of nail form 200A can be formed with a specific apex (e.g., where the apex for curvature 222A and curvature 224A are the same). In some embodiments, the cavity formed by the curvatures of the bottom surface 206A may be shaped for a desired coating shape or thickness. For example, a subject may desire a thin nail coating and the cavity can be designed as a shallow cavity. In another example, a subject may desire a nail coating with varying thicknesses at different parts of the nail coating—for example, a thicker coating at the apex.

In some embodiments, the apex 232A can aid in building the thickest amount of nail coating and position the thickest nail coating in a location that covers the natural nail's stress area. The stress area can be part of the natural nail that experiences the most pressure and the most pressure. This area may be located between the middle of the nail plate and the nail edge of the natural nail, where breaks most often occur. In some embodiments, the nail coating can gradually taper (in an arc) from the apex 232A to a thinner layer at the tip of the nail form 200A. The nail coating can also transition smoothly from the apex 232A toward the cuticle and sides of the natural nail.

In some embodiments, the top surface 204 can have curvature(s) the same and or similar as curvature 222A and/or curvature 224B. The curvature(s) of the top surface 204A can be convex. In other embodiments, the top surface 204 has a curvature and/or shape that is different from bottom surface 206A.

In some embodiments, the bottom surface 206A of the body 202A may have an enhancement such as a texture, shapes, or nail art formed within or thereon to alter the top surface of the nail coating. In some embodiments, the bottom surface 206A can include one or more recessed features (e.g., debossed features) to imprint a recessed design in the nail coating. For example, the bottom surface 206A may have horizontal or vertical lines (front to back) etched out of the bottom surface 206A to create raised lines on the nail coating. In some embodiments, the bottom surface 206A may include one or more raised features (e.g., embossed features) to imprint features into the nail coating. For example, the bottom surface 206A may include raised circular or raised diamond shapes to imprint into the nail coating. In another example, one or more embellishments (e.g., beads, rhinestones, etc.) can be positioned in or on the bottom surface 206.

In some embodiments, nail form 200A (e.g., body 202A of nail form 200A) can include a guide feature located at bottom surface 206A of the body 202A. The guide feature can promote a nail coating coupled to the bottom surface 206A of the body 202A to distribute towards an apex, such as apex 232A of curvature 222A and/or curvature 224A. Additional details of the guide feature are further described with respect to FIG. 3A and FIG. 3B.

Figure 2B:
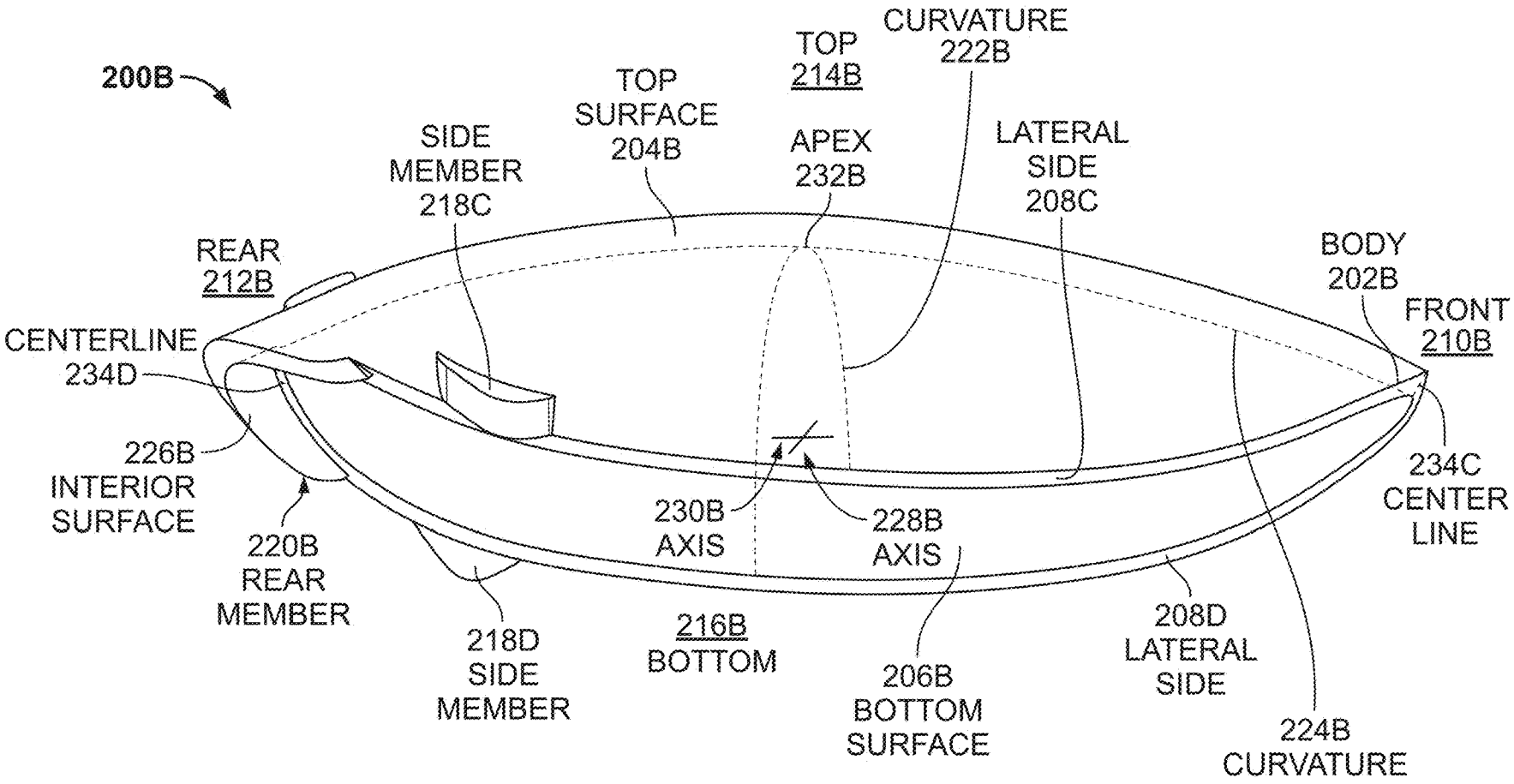
FIG. 2B illustrates a side perspective view of a nail form, in accordance with some embodiments of the disclosure.

FIG. 2B illustrates a side perspective view of a nail form, in accordance with some embodiments of the disclosure. Nail form 200B (generally referred to as "nail form 200" herein) illustrates a nail form of a second type (e.g. type B). Nail form 200B can include a top 214B (generally referred to as "top 214" herein), a bottom 216B (generally referred to as "bottom 216" herein), a front 210B (generally referred to as "front 210" herein), and a rear 212B (generally referred to as "rear 212" herein). Nail form 200B can also include a right half and left half that extend downward to the bottom 216B from curvature 224B extending between the front 210B and rear 212B of the nail form 200B.

In some embodiments, the nail form 200B can include a body 202B (generally referred to as "body 202" herein) having components as illustrated and described herein. In some embodiments, the body 202B can include a top surface 204B (generally referred to as "top surface 204" herein) and a bottom surface 206B (generally referred to as "bottom surface 206" herein) positioned opposite the top surface 204B. In some embodiments, the bottom surface 206B can include one or more curvatures, such as curvature 222B that forms a cavity in a shape, such as in a shape of a natural nail.

In some embodiments, body 202B can include lateral side 208C and lateral side 208D (generally referred to as "lateral side(s) 208" herein). Centerline 234C and centerline 234D (generally referred to as "centerline 234" herein) can refer to the same centerline but at different locations of the nail form 200B.

In some embodiments, nail form 200B can include one or more side members, such as side member 218C and side member 218D (generally referred to as "side member(s) 218" herein).

In some embodiments, the nail form 200B includes a rear member 220B (generally referred to as "rear member 220" herein). In some embodiments, the bottom surface 206B can have a curvature 222B along a first axis, such as axis 228C. The curvature 222B can have an apex, such as apex 232B. In some embodiments, the bottom surface 206B can have a curvature 224B along another axis, such as axis 230B. In some embodiment, curvature 224B also has an apex, such as apex 232B.

In some embodiments, nail form 200B (e.g., body 202B of nail form 200B) can include a guide feature located at bottom surface 206B of the body 202B. Additional details of the guide feature are further described with respect to FIG. 3A and FIG. 3B.

In some embodiments, the nail form 200 ranges in size from about 5 millimeters (mm) to about 1.9 centimeters (cm wide) and about 2.9 cm to about 4.8 cm long. In some embodiments, the nail form 200 can be in different shapes (or style). For example, the nail form 200 can be in a shape of at least one of round, almond, squoval, coffin, oval, square, or stiletto.

In some embodiments, the components of nail form 200B can be the same or similar to the components of nail form 200A. For the sake of clarity and brevity, the description of FIG. 2A is not repeated in FIG. 2B. It can be understood that the description of FIG. 2A and the components thereof can apply equally to FIG. 2B and the components thereof, unless otherwise described.

Figure 2C:
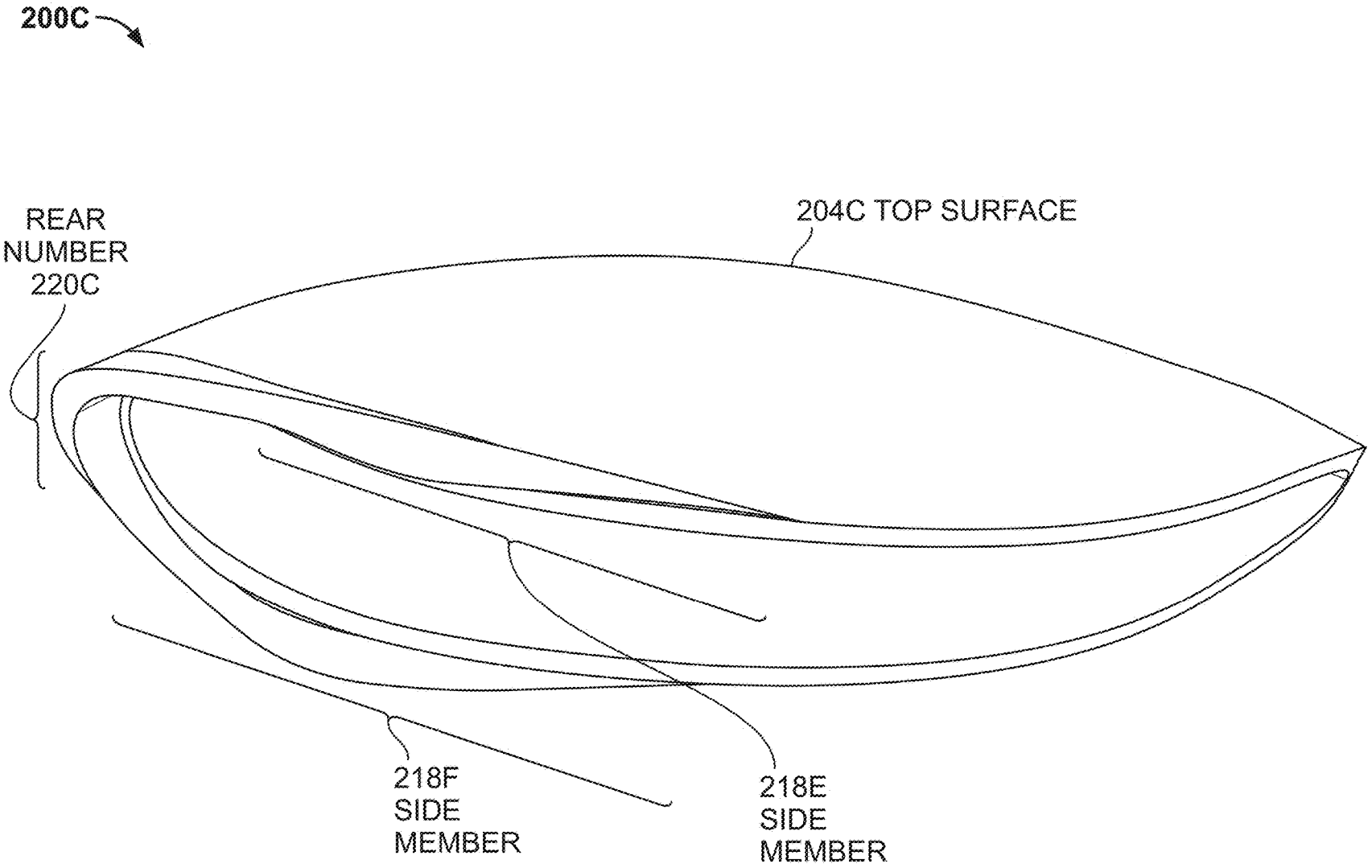
FIG. 2C illustrates a side perspective view of a nail form, in accordance with some embodiments of the disclosure.

FIG. 2C illustrates a side perspective view of a nail form, in accordance with some embodiments of the disclosure. Nail form 200C (generally referred to as "nail form 200" herein) illustrates a nail form of a third type (e.g. type C).

In some embodiments, the components of nail form 200C can be the same or similar to the components of nail form 200A and/or nail form 200B. For the sake of clarity and brevity, the description of FIG. 2A and FIG. 2B is not repeated in FIG. 2C. It can be understood that the description of FIG. 2A and FIG. 2B and the components thereof can apply equally to FIG. 2C and the components thereof, unless otherwise described. It can be appreciated that although all the components of FIG. 2C are not labeled, the components described in FIG. 2A and FIG. 2B can be part of nail form 200C, unless otherwise described.

Nail form 200C illustrates a nail form having integrated side members and rear member, such as side member 218E, side member 218F (generally referred to as "side member 218" herein) and rear member 220C (generally referred to as "rear member 220" herein). In some embodiments, the integrated side members and rear member can be unified. In some embodiments, the integrated side members can be formed of contiguous members that wrap around a rear portion of the top surface 204C.

It can be appreciated that in some embodiments components of the various nail form types (e.g., nail form 200A, nail form 200B, and nail form 200C) can be mixed, interchanged, and/or combined.

The following figures illustrate different views of nail form 200A of FIG. 2A, nail form 200B of FIG. 2B, and nail form 200C of FIG. 2C. It can be appreciated that the description and components of FIG. 2A, FIG. 2B and FIG. 2C apply equally to the following figures, unless otherwise described, and is not repeated for the sake of clarity and brevity.

Figure 3A:
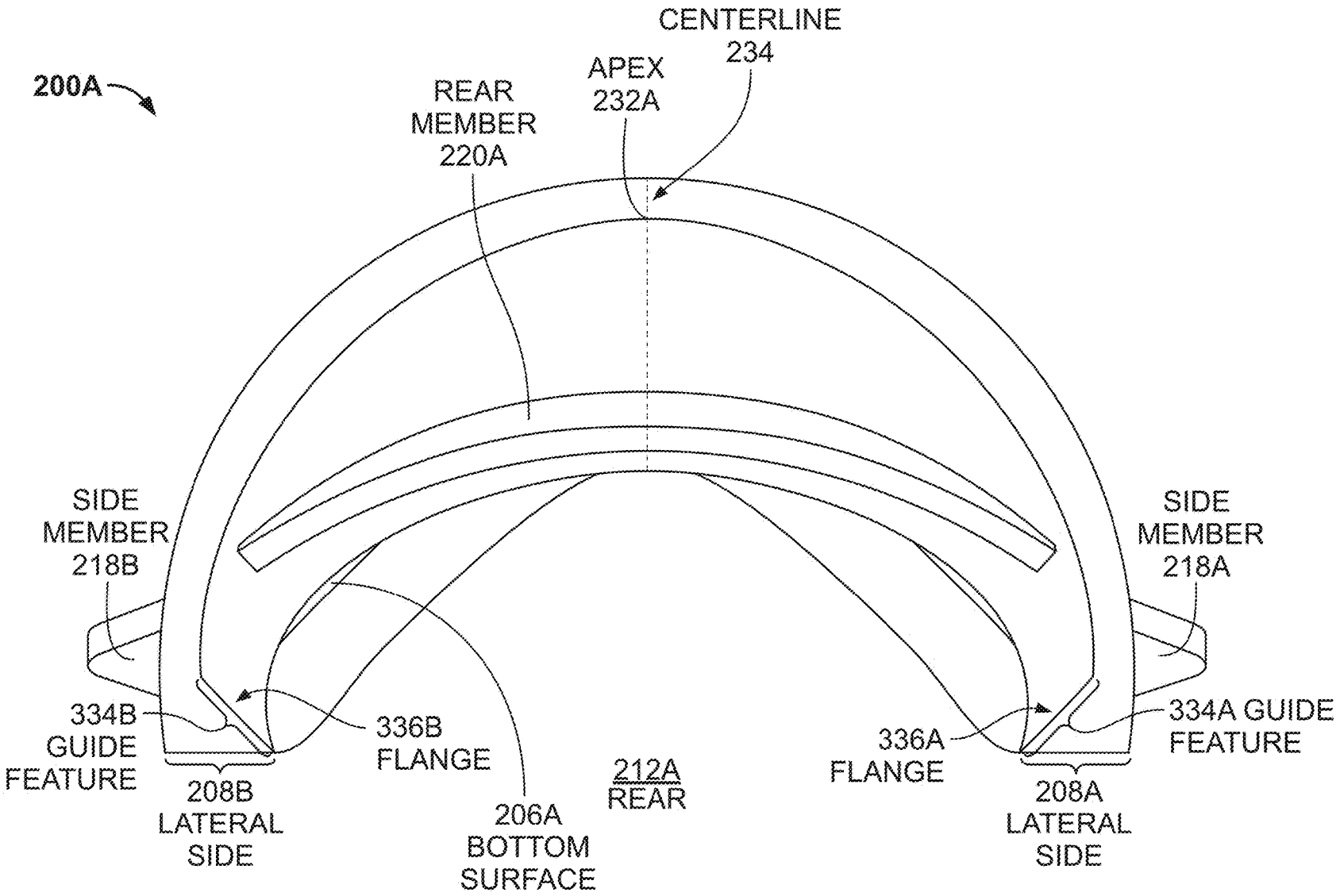
FIG. 3A illustrates a rear view of a nail form, in accordance with some embodiments of the disclosure.

FIG. 3A illustrates a rear view of a nail form, in accordance with some embodiments of the disclosure. Nail form 200A includes a guide feature, such as guide feature 334A and guide feature 334B (generally referred to as "guide feature 334" herein). Guide feature 334A and guide feature 334B can illustrate the guide feature 334 on different halves of the nail form 200A. In some embodiments, the guide feature 334 promotes a nail coating coupled to the bottom surface 206A of the body to distribute towards the apex 232A of the curvature 222A (e.g., apex of the cavity or apex of the bottom surface 206A)

In some embodiments, the guide feature 334 can be contiguous (e.g., wrap around) along the bottom portion of the bottom surface 206A opposite the lateral side 208. The guide feature 334 can be formed along the circumference of the opening of the cavity of the nail form 200A.

In some embodiments, the guide feature 334 includes a flange, such as flange 336A and flange 336B (also referred to as "flange(s) 336" herein), that extends inwardly (e.g., towards the apex 232A and/or centerline 234). In some embodiments, flange 336 can be angled as illustrated. In some embodiments, flange 336 can be substantially flat (e.g., +10 degrees). The flange 336 can help prevent a nail coating from leaking out from the cavity of the body of nail form 200A. In some embodiments, a vector normal the flange 336 points inwardly (e.g. (e.g., towards the apex 232A and/or centerline 234 and/or another portion of the bottom surface 206A).

Figure 3B:
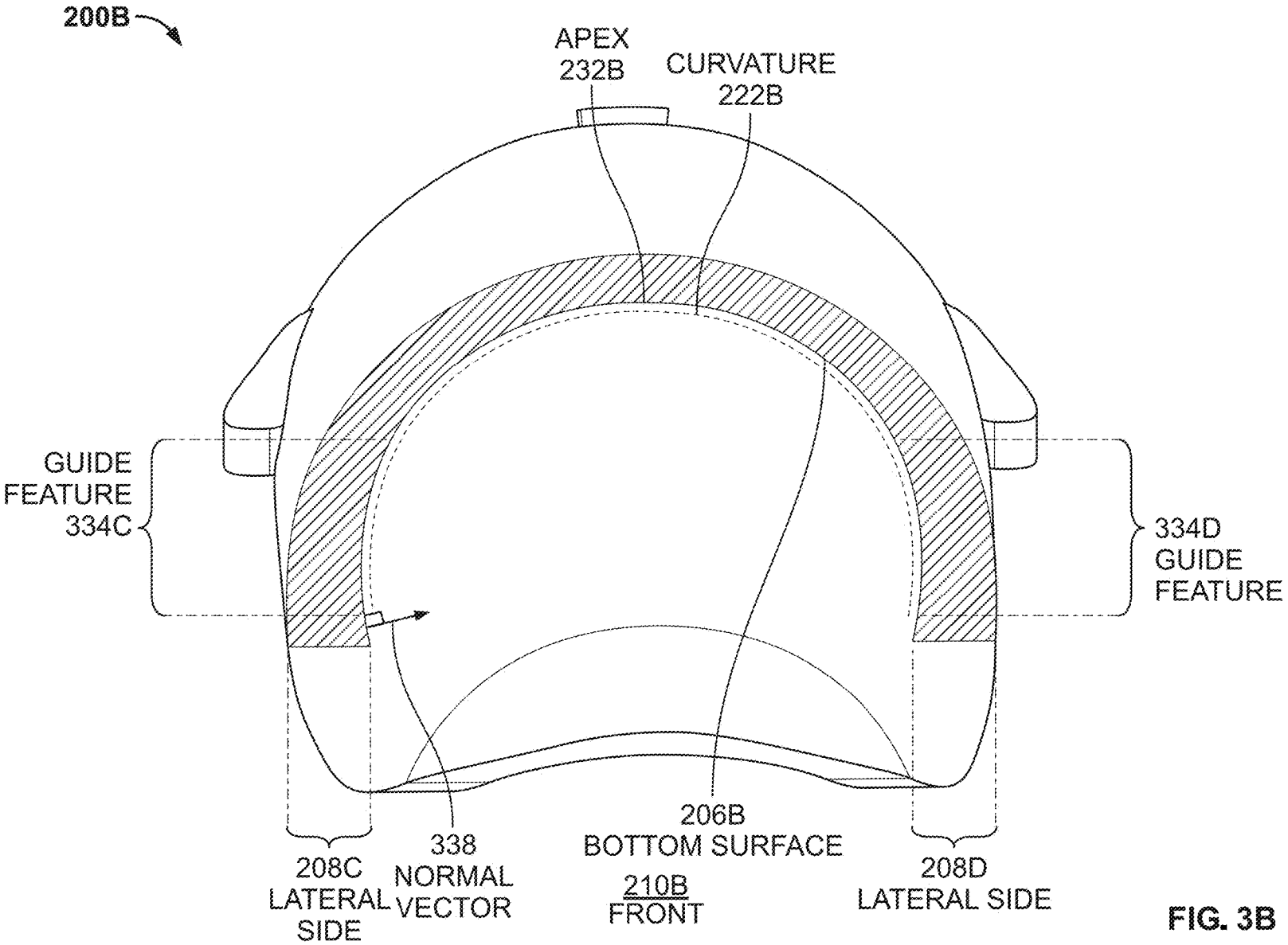
FIG. 3B illustrates a front cross-sectional view of a nail form, in accordance with some embodiments of the disclosure.

FIG. 3B illustrates a front cross-sectional view of a nail form, in accordance with some embodiments of the disclosure. FIG. 3B shows a cross-section from a front view of the nail form 200B. Nail form 200B includes a guide feature, such as guide feature 334C and guide feature 334D (generally referred to as "guide feature 334" herein). As described herein, in some embodiments, guide feature 334 promotes a nail coating coupled to the bottom surface 206B of the body to distribute towards the apex 232B of curvature 222B.

In some embodiments, the curvature 222B of the bottom surface 206B can be designed to facilitate the utility of the guide feature 334. The curvature 222B (or at least a portion thereof) can be designed to promote a nail coating coupled to be bottom surface 206B to distribute towards the apex 232B of curvature 222B responsive to the application of downward pressure during the application of the nail form 200B.

In some embodiments, the curvature 222B can be a complex curvature. In some embodiments, the bottom surface 206B of the nail form 200B includes a cavity defined by non-uniform curvatures (e.g., curvature 222B and/or curvature 224B) that deviate from perfect circular arcs. The lower portions of these curves (e.g., guide feature 334C and/or guide feature 334D) exhibit more curvature (more sharply curved) than the upper portions (e.g., above guide features 334). For example, the portion of curvature 222B shown by guide feature 334C and guide feature 334D have a higher degree of curvature than other portions of curvature 222B located closer to apex 232B. In some embodiments, the degree of curvature of guide feature 334 is such that a normal vector 338 points upwards towards the apex 232B of the cavity or towards an opposite portion of the bottom surface 206B. In some embodiments, the normal vector 338 does not point towards a portion of bottom surface 206B directly opposite as would be the case with parallel planes. In some embodiments, the normal vector 338 can intersect the opposite portion of the bottom surface 206B at oblique angles. The design of curvature 222B (and curvature 224B) of the bottom surface 206B and in particular the design of curvature of the guide feature 334 can create a contoured inner cavity that is highly specialized for preventing a nail coating from being squeezed out during the application the nail form 200B. In other embodiments, the curvature 222B can be a circular arc of a perfect circle that extends greater than 180 degrees (e.g., major arc).

In some embodiments, the thickness (e.g., between the bottom surface 206B and the top surface 204B) can be tapered from the lateral sides 208 towards the apex 232B, as illustrated. In some embodiments, the guide feature 334 can be implemented using the tapered thickness.

Figure 4A:
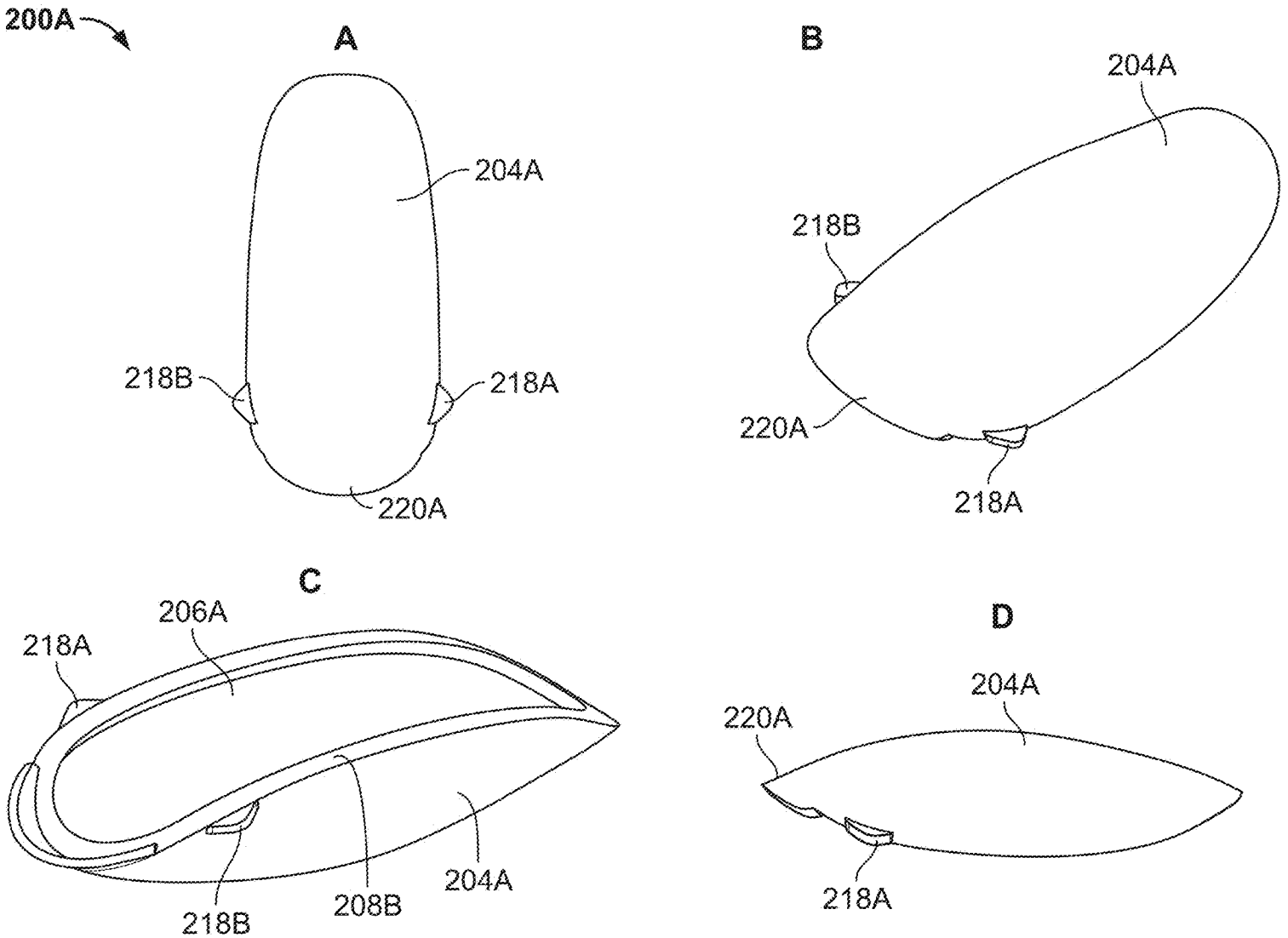
FIG. 4A shows different views of a nail form, in accordance with some embodiments of the disclosure.

FIG. 4A shows different views of a nail form, in accordance with some embodiments of the disclosure. Nail form 200A is illustrated in views A, B, C, and D. View A shows a top view of nail form 200A. View B shows a side perspective view of nail form 200A. View C shows a bottom perspective view of nail form 200A. View D shows a right-side view of nail form 200A.

Figure 4B:
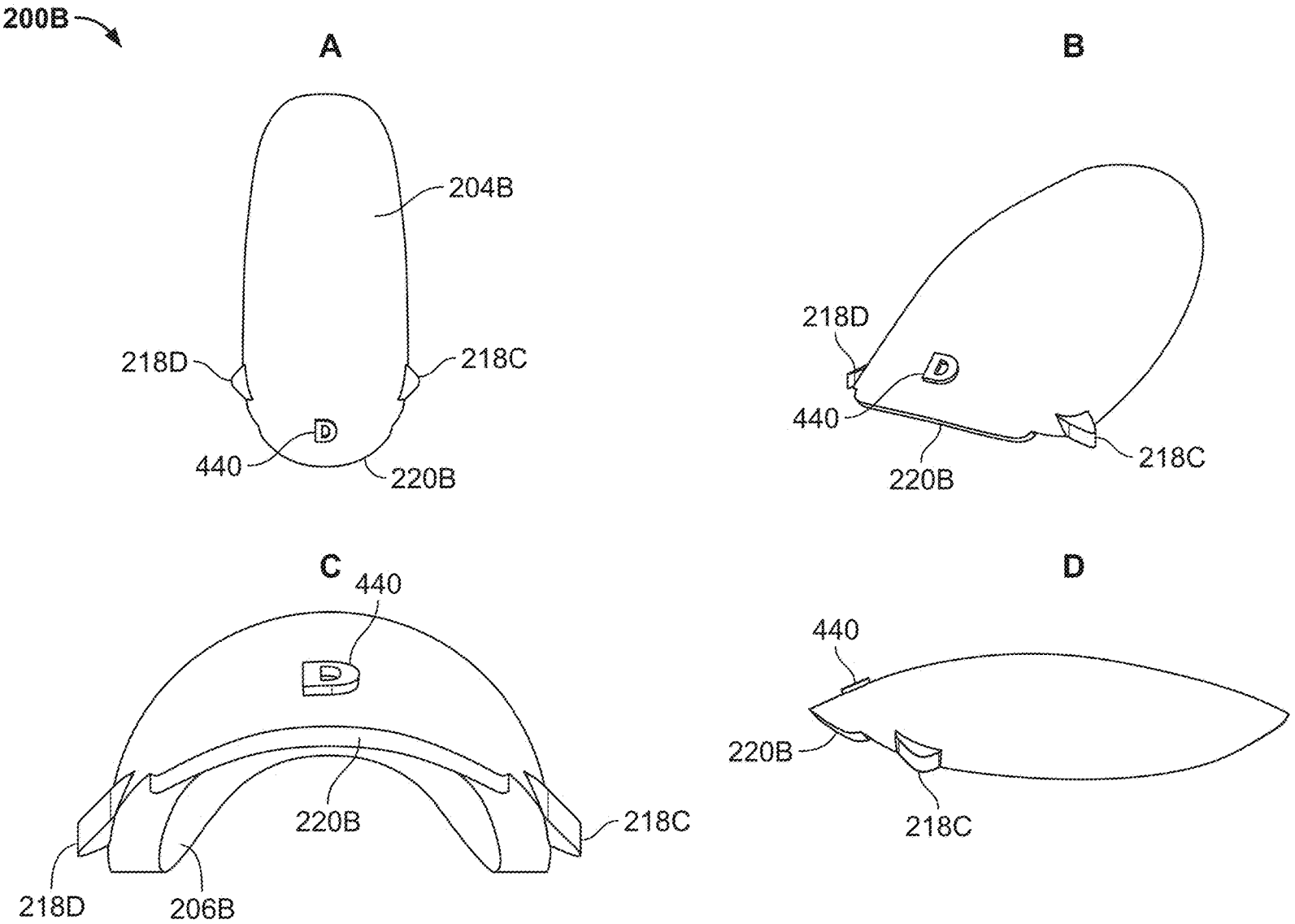
FIG. 4B shows different views of a nail form, in accordance with some embodiments of the disclosure.

FIG. 4B shows different views of a nail form, in accordance with some embodiments of the disclosure. Nail form 200B is illustrated in views A, B, C, and D. View A shows a top view of nail form 200B. View B shows a rear top perspective view of nail form 200B. View C shows a rear view of nail form 200B. View D shows a right-side view of nail form 200B.

Views A, B, C, and D illustrate a marking 440 (e.g., the letter "D") on the top surface 204B of nail form 200B. In some embodiments, the marking 440 can indicate a size of the nail form, such as the size of nail form B. For example, a set of nail forms can include multiple nail forms of different sizes. In some embodiments, the different sizes can correspond to different sizes of fingers of a hand (e.g., the pinky size is smaller than a thumb size). In some embodiments, the different sizes can correspond to differently sized fingers among subjects (e.g., ring fingers and the natural nail thereon can be different among people). In some embodiments, the marking 440 can be raised from the top surface 204B (e.g., embossed). In some embodiments, the marking 440 can be engraved or etched (e.g., debossed) in the top surface 204B. In some embodiments, the marking 440 can be inlaid within the material of the nail form 200A and visible through one or more of the top surface 204B or bottom surface 206B.

Figure 4C:
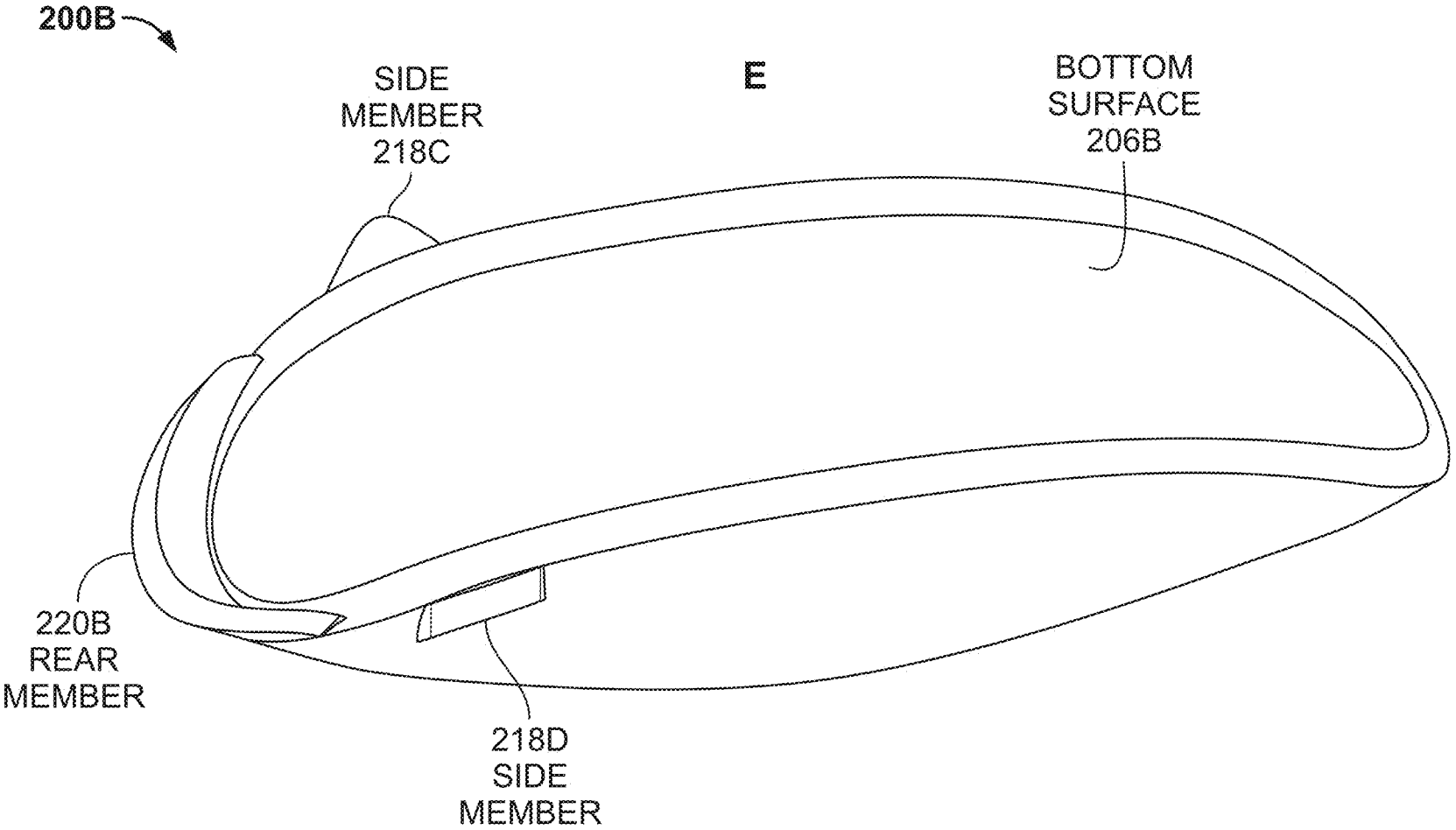
FIG. 4C shows a view of a nail form, in accordance with some embodiments of the disclosure.

FIG. 4C shows a view of a nail form, in accordance with some embodiments of the disclosure. Nail form 200B is illustrated in view E. View E shows a bottom perspective view of nail form 200B.

Figure 4D:
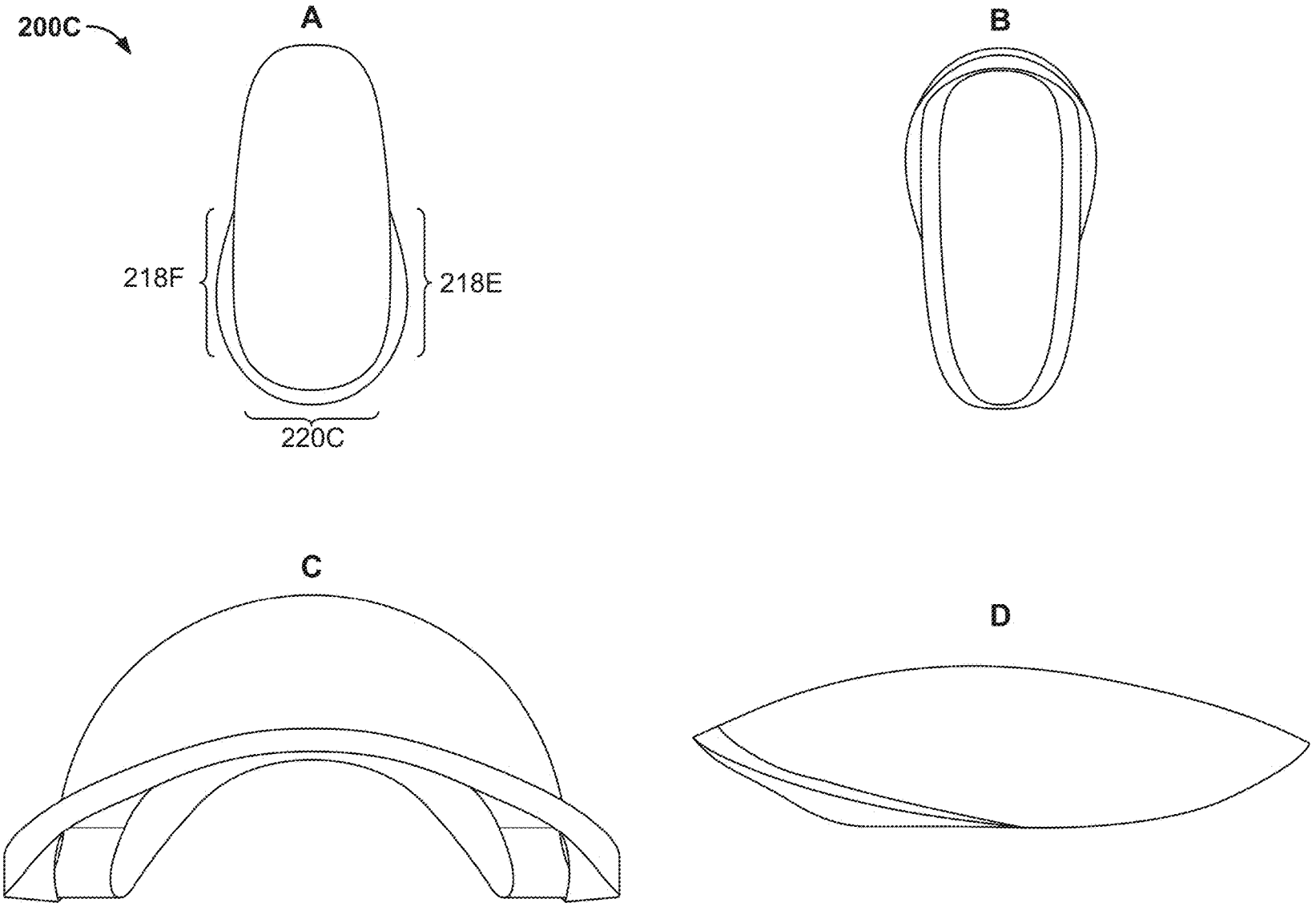
FIG. 4D shows different views of a nail form, in accordance with some embodiments of the disclosure.

FIG. 4D shows different views of a nail form, in accordance with some embodiments of the disclosure. Nail form 200C is illustrated in views A, B, C, and D. View A shows a top view of nail form 200C. View B shows a bottom view of nail form 200C. View C shows a rear view of nail form 200C. View D shows a right-side view of nail form 200C.

Figure 5:
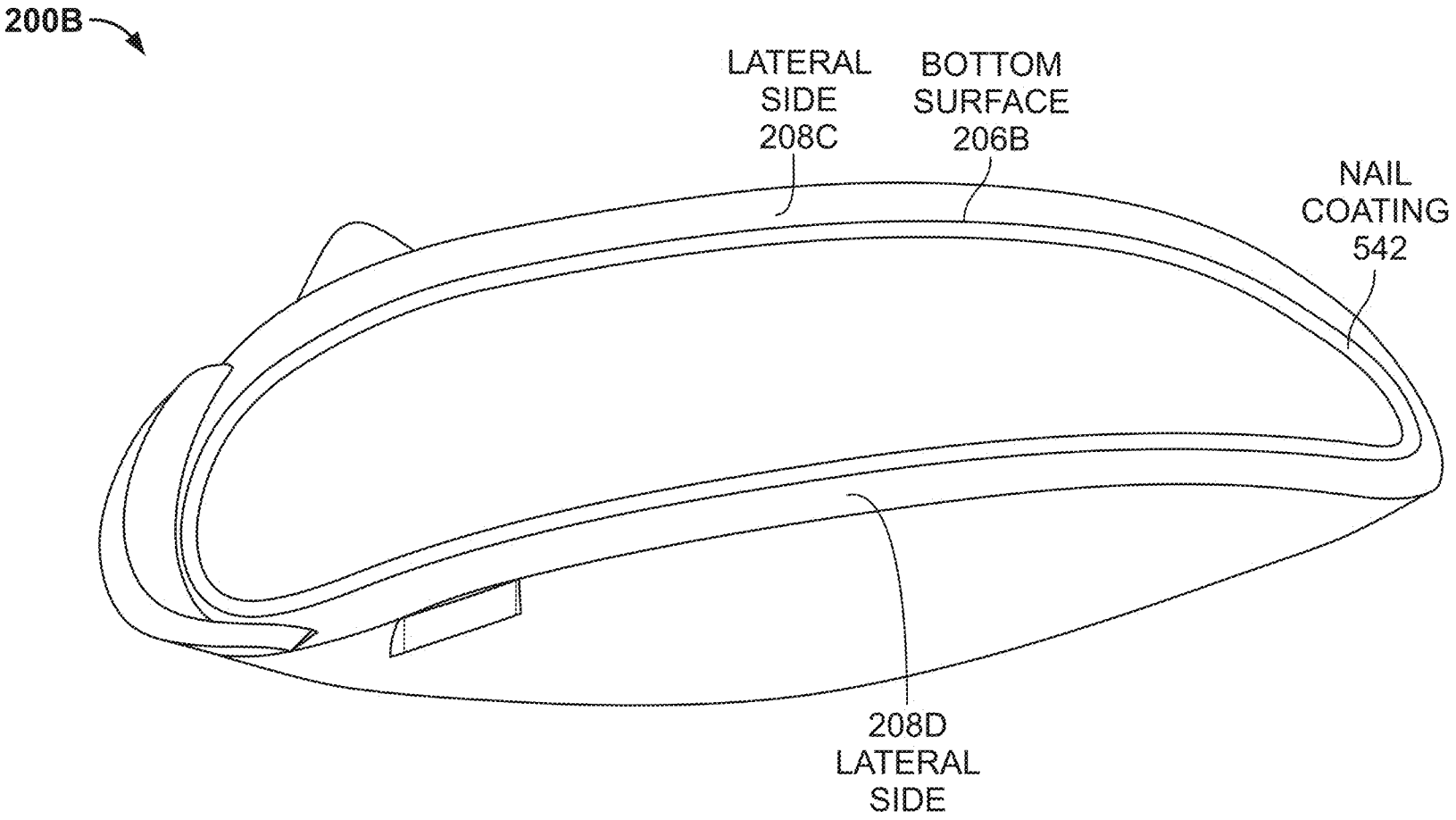
FIG. 5 illustrates a nail coating disposed within the cavity of the body of the nail form, in accordance with some embodiments of the disclosure.

FIG. 5 illustrates a nail coating disposed within the cavity of the body of the nail form, in accordance with some embodiments of the disclosure.

As described herein, the nail form, such as nail form 200B, is used to apply a nail coating 542 on the natural nail of a subject. It can be appreciated that although nail form 200B is shown, that any type of nail form, such as nail form 200A, can be used in a similar manner. The description of FIG. 5 also pertains to nail form 200A. Nail coating 542 is shown disposed on the bottom surface 206B of the nail form 200B. In some embodiments, nail coating 542 is disposed up to (but not on) lateral sides 208. In some embodiments, the nail coating 542 is removably attached to bottom surface 206B of the body of the nail form 200B.

A nail coating 542 can refer to a protective and/or decorative coating applied to a surface of a natural nail. In some embodiments, a nail coating 542 is or includes an artificial nail. In some embodiments, the nail coating 542 includes one or more sections of an artificial nail (but not all the sections, in some instances). In some embodiments, a nail coating 542 can include one or more sections of materials, such an adhesive section, a base coat section, a color section, or a top coat section. In some embodiments, one or more sections can be stacked on one another to form a nail coating 542. In some embodiments, a section of a nail coating 542 can have one or more layers, where each layer of a section includes the same or similar material. In some embodiments, the sections and layers can be stacked on top of one another to form a nail coating 542.

In some embodiments, the nail coating 542 includes at least one of a polish, gel, polygel, acrylic gel, and polymer composition. In some embodiments, the nail coating 542 includes a polymer composition configured to conform to the bottom surface 206 of the nail form 200B. In some embodiments, the nail coating 542 (and in particular pre-applied nail coating) can be in an uncured or semi-cured state. In some embodiments, the nail coating 542 can be fully cured. In some embodiments, the polymer composition is light-curable (e.g. photocurable). In some embodiments, a light-curable composition is cured using electromagnetic radiation, such UV light (e.g., UV curable) or light from a light-emitting diode (LED) (e.g., LED curable). In some embodiments, the polymer composition is non-light curable.

In some embodiments, at least one section (or layer) of the nail coating 542 includes a light-curable composition, such as gel-based composition, that is semi-cured. The semi-cured light-curable composition can be elastic and/or flexible to bend, flex and/or stretch (e.g. be shaped) to conform to a shape of a natural nail, which improves the bond between the coating and the nail and makes the coating appear more natural than other artificial nails. In some embodiments, the adhesive section (e.g., base coat) that attaches the nail coating 542 to the natural nail is in a semi-cured state. In some embodiments, the nail coating 542 in a semi-cured state is a light-curable composition, such as a gel-based base coat. In some embodiments, the semi-cured material remains tacky and sticky in the semi-cured state. A subject can place the nail form 200 with the nail coating with the semi-cured material on the natural nail, apply pressure to the nail form 200 with the nail coating with the semi-cured material and cure (e.g., fully cured) the nail coating with light concurrently with the application of pressure.

In some embodiments, a light-curable composition can include a gel composition. In some embodiments, a gel composition can be a composition that can be semi-solid in an uncured state. In some embodiments, the gel composition in an uncured or semi-cured state can include one or more oligomers.

In some embodiments, multiple sections of the nail coating 542 can include a light-curable compositions in a semi-cured state. For example, an adhesive section can include a light-curable composition and a polish section or topcoat section can include the same or different light-curable composition (e.g., such as a gel-based nail polish or gel-based topcoat section, respectively) in a semi-cured state.

In some embodiments, one or more of the sections of the nail coating can include a non-light-curable composition. For example, an adhesive section can include a light-curable composition and the polish section or topcoat section can include a non-light-curable composition.

In some embodiments, a section of the nail coating includes a supplemental material that can help provide strength and/or structure to the nail coating 542. For example, a section of the nail coating can include a fiberglass material disposed between other sections of the nail coating.

In some embodiments, the nail coating 542 uses pressure during the application process to cure or attach to the natural nail. In some embodiments, the nail coating uses both light and pressure (e.g., concurrently) during the application process to cure.

In some embodiments, at least the body of the nail form 200 is formed of a transparent or semi-transparent material. In some embodiments, the entirety of the nail form 200 is formed of a transparent or semi-transparent material. The transparent or semi-transparent material can allow for photocuring of the underlying nail coating 542. In some embodiments, some components of the nail form 200 are not transparent. For example, one or more of the rear member 220 or side members 218 can be opaque.

In some embodiments, the nail coating 542 is a pre-applied nail coating that is pre-applied at the time of manufacture to form a prefilled nail form. For example, the prefilled nail form having nail coating 542 can be provided in packaging for sale to customers. In another example, a protective sheet or coating can be applied to the exposed surface of the nail coating 542 of the prefilled nail form 200B. In other embodiments, the nail coating 542 is not pre-applied. A subject can apply nail coating 542 to the bottom surface 206B of nail form 200B prior to use. In some embodiments, a non-stick coating can be disposed on the bottom surface 206B of the body of the nail form 200B. In some embodiments, the material of nail form 200B and in particular of the bottom surface 206B can include a non-stick material. In some embodiments, the lateral side(s) 208 of the nail form 200B can include a hydrophobic coating.

In some embodiments, the nail coating 542 may be removed from the natural nail using various types of removal (e.g., physical and/or chemical removal). For example, a nail coating 542 may be removed from the natural nail with a required physical force. A required force may be any amount of force or pressure required to fracture the nail coating. In some examples, the required force may be filing or buffing the nail coating. In other examples, a nail coating may be removed with chemicals.

In some embodiments, the nail form 200 can be formed of a single material. In some embodiments, the nail form 200 can be formed of multiple materials. In some embodiments, the components of the nail form 200 can be made of a monolithic material. In some embodiments, the nail form 200 can be formed of multiple components that are attached to one another. For example, the side members 218 can be attached to the body 202 of the nail form 200. In some embodiments, the nail form 200 is flexible so that the subject can bend or mold the nail form 200 during placement on a natural nail.

In some embodiments, the nail form 200 may be coated or infused with compositions. For example, one or more of the side members 218, the rear member 220, or the lateral sides 208 which can contact the natural nail during application may be coated with nail or skin preparation, additives or supplements (e.g., aloe, Vitamin E), or treatments. In one example, the nail form 200 may have cuticle oil layers or infused to moisturize and hydrate the nail plate or cuticle. In another example, the lateral sides 208 may be coated with a filler composition that acts as a caulking agent to provide a smooth, gap-filling bond for natural nails that may have divots or not have a uniform surface and to achieve a smooth nail coating line.

In some embodiments, the nail form 200 can part of a kit. The kit can include multiple nail forms. In some embodiments, the kit can include a nail coating 542. In some embodiments, the multiple nail forms are prefilled nail forms (e.g., using pre-applied nail coating). In some embodiments, the multiple nail forms are not prefilled. In some embodiments, the multiple nail forms are stored in a container. In some embodiments, the nail forms are of different sizes to conform to the natural nails of different fingers or different toes. In some embodiments, the kit may also include one or more various materials, including at least one of a nail coating remover, a spatula, a brush, a slip solution, nail treatments or supplements, and/or a curing system.

In some embodiments, one or more nail forms can be included in a system. In some embodiments, the system can include a light source to cure the nail coating 542. In some embodiments, the system includes a pressure source to apply pressure to the top surface of the nail forms. In some embodiments, the light source and pressure source are integrated into a single device. In some embodiments, the light source and pressure source are separate devices. In some embodiments, the pressure source is transparent or semi-transparent to permit the transmission of light to cure the nail coating 542. In some embodiments, light and pressure can be applied concurrently to cure and attach the nail coating to the natural nail.

In some embodiments, the nail form or multiple nail forms can be purchased as prefilled nail forms or non-prefilled nail forms. In some embodiments, after use of the initial nail forms, the used nail forms can be reused one or multiple times. For example, after an initial application of a nail coating 542, the nail form can be refilled by, for example, the subject and reused for subsequent applications of nail coatings.

In some embodiments, the same nail form can be used to apply an artificial nail of different shapes. In some embodiments, nail inserts can be placed within the cavity of the nail form to change the shape of the cavity and the shape of the resultant nail coating. In particular and in some embodiments, the nail insert can change the shape of the front portion of the cavity (and the tip of the nail coating) while the remaining portions of the cavity remain the same shape. For example and in some embodiments, the nail insert can be configured to be inserted in the front portion of the cavity of the nail form. The rear side (facing the rear of the nail form at application) of the nail insert can have a shape that defines the shape of the end (e.g., tip) of the nail coating. For instance, the rear side of the nail insert can have a crescent shape to give the resultant nail coating an oval shape. In another instance, the rear side of the nail insert can have a long V-shaped indentation that creates a nail coating with a long sharply pointed tip of a stiletto-shaped artificial nail. In some embodiments, after placing the nail insert in the cavity of the nail form, a subject can apply the nail coating at the bottom surface of the body of the nail form in the newly defined shape. In some embodiments, the nail inserts can be removed from the nail form and interchanged with other nail inserts having different shapes.

The terms "photocurable" or "light-curable" can refer to a material, substance or composition that can be chemically changed to form stronger and/or harder bonds upon exposure to specific wavelengths of electromagnetic radiation. For example, in some embodiments a light-curable composition can be cured by a polymerization process where the composition's molecules react by linking up with one another into large chains of polymers upon exposure to one or more wavelengths of light. Crosslinks, or chemical bonds, that connect different polymer chains together, also may be created, forming a structurally strong molecular network.

In some embodiments, the term "semi-cured state" (e.g., partially cured) refers to a light-curable composition that has been cured (e.g., by exposure to electromagnetic radiation) for less than an amount of time to fully cure the light-curable composition. In a semi-cured state, exposure to additional amounts of specified wavelength(s) of electromagnetic radiation can cause the light-curable composition to further chemically change to form stronger and/or harder bonds. In some embodiments, the term "semi-cured state" refers to a light-curable composition that is at least one of elastic, semi-solid, malleable, formable, clay-like, stretchable or combinations thereof and/or may have a Shore A (Durometer) hardness of less than about 90.

The term "cured state" refers to a light-curable composition that is hard, durable and resistant to breaking and/or has a Rockwell hardness of about 1 gram(s) per cubic centimeter (g/cc) to about 110 g/cc, and/or a Shore D hardness of about 10 to about 100. In a cured state, exposure to additional amounts of specified wavelength of electromagnetic radiation does not cause or does not appreciably cause the light-curable composition to further chemically change to form stronger and/or harder bonds. For example, in the cured state, the polymerization process can be substantially complete.

In some embodiments, method 600 can be performed by a subject or professional technician. In some embodiments, method 700 can be performed using one or more pieces of manufacturing equipment, an operator, or combination thereof (e.g., collectively or individually referred to as "equipment" herein). The operations of methods 600 and 700 are described as performed serially for purposes of illustration, rather than limitation. In some embodiments, the operations can be performed in parallel. In some embodiments, the same, different, greater, or fewer operations can be performed. In some embodiments, the operations can be performed in the same or different order.

Figure 6:
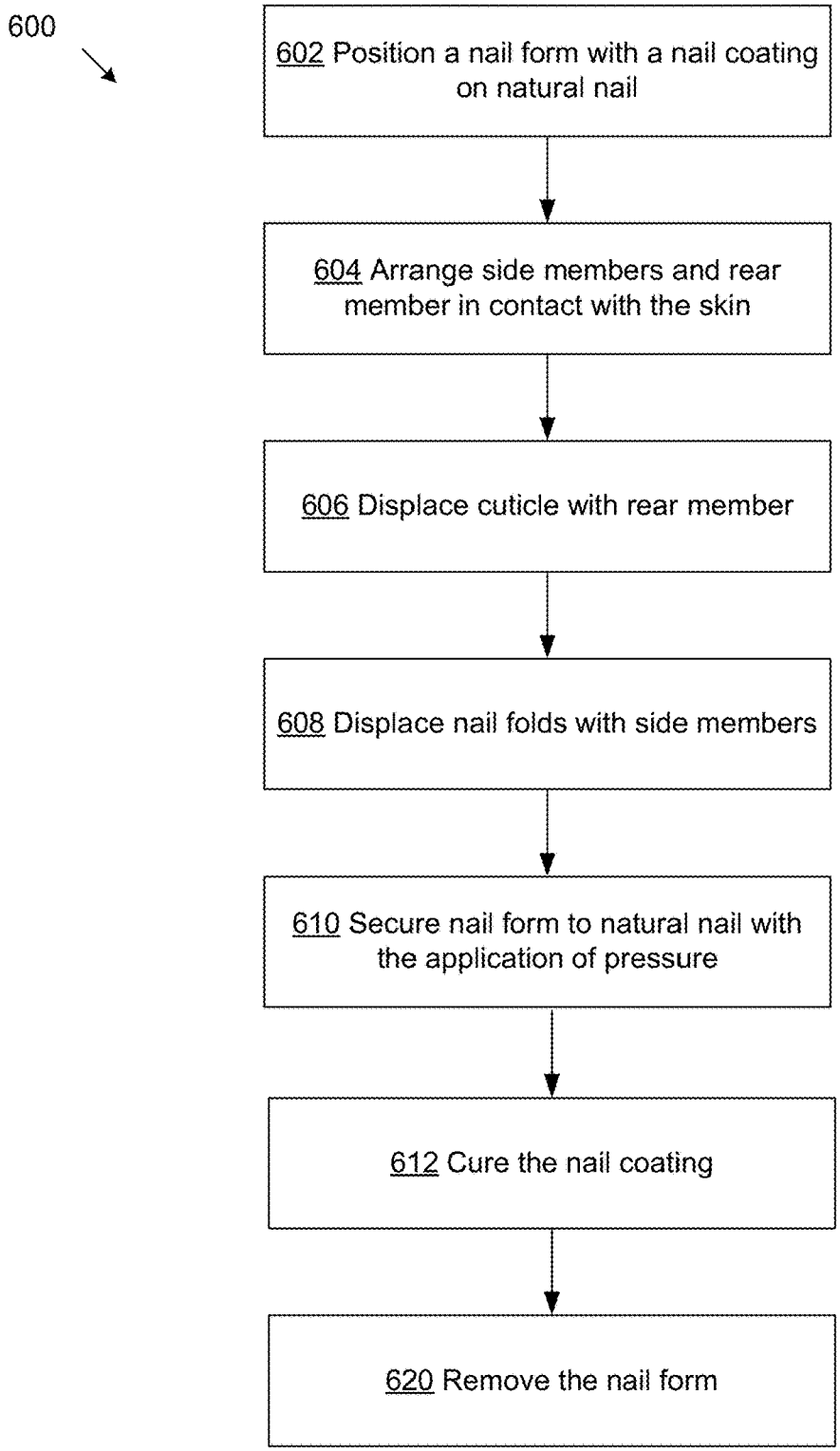
FIG. 6 illustrates an example flow chart of using a nail form, in accordance with some embodiments.

FIG. 6 illustrates an example flow chart for using a nail form, in accordance with some embodiments. In some embodiments, the application of the nail coating using the nail form 200 can include an entire manicure (e.g., 1-step manicure of an artificial nail). In some embodiments, the application of the nail coating using the nail form 200 can be part of the manicure process. For instance, a base coat can be applied prior to applying then nail coating using the nail form 200. In some embodiments, multiple applications of the same nail form or different nail forms on the same natural nail can be part of the manicure process.

Method 600 may be implemented by placing a nail form with a nail coating on a natural nail either in a home or professional setting. At operation 602 of method 600, the nail form with a nail coating is positioned on a natural nail. The nail form may be pre-filled or filled at the time of application.

At operation 604, side members located on the sides of the nail form and the rear member are arranged on the natural nail in contact with the skin (e.g., cuticle and/or nail folds).

At operation 606, the cuticle may be displaced by the side members and/or the rear member. For example, the nail form may be placed using the rear member contacting the cuticle. The rear member can move the cuticle back and expose more of the nail plate of the natural nail for nail coating coverage. In some embodiments, the rear member can provide stability to the nail form arranged on the natural nail.

At operation 608, the side members can be used to displace the lateral nail folds. The side members can move the lateral folds away from the nail plate and expose more of the nail plate of the natural nail for nail coating coverage. In some embodiments, the side members can provide stability to the nail form arranged on the natural nail.

At operation 610, the nail form is secured to the natural nail with the application of pressure. In some embodiments, pressure can be applied to the nail form, which cause contact between the bottom side of the nail coating to the natural nail. In some embodiments, the nail form, including the side members and the rear member, can remain in place during pressure application.

At operation 612, the nail coating is cured. In some embodiments, the nail coating is cured when the nail form is disposed on the natural nail. In some embodiments, curing the nail coating is performed by exposing the nail coating to a light source (e.g., UV or LED). In some embodiments, the nail form may be transparent or (allowing all light to pass through) or translucent (allowing some light to pass through) to permit the nail coating to be exposed to light from the light source. In some embodiments, curing the nail coating can include the application of pressure from a pressure source. In some embodiments, the application of pressure is provided concurrently with the exposure to light from the light source. In some embodiments, curing includes the application of thermal radiation (e.g., heat). In some embodiments, after the nail coating is cured, the nail form is removed from the natural nail. The nail coating remains on the natural nail. The nail coating will have clean lines and be at a desired placement on the natural nail.

In some embodiments, providing a manicure using the nail form can in include one or more of the following operations in any order. In some embodiments, an operation includes cleaning the nail plate to prevent lifting. In some embodiments, an operation includes filing the natural nail. In some embodiments, an operation includes buffing the natural nail. In some embodiments, an operation includes applying one or more layers of base coat. In some embodiments, an operation includes curing the base coat using a curing apparatus (e.g., a UV or LED light for 60 seconds). In some embodiments, an operation can includes selecting a nail form in a size slightly larger a subject's natural nail. In some embodiments, an operation can include if the nail form is pre-filled with a nail coating, apply the nail form to the nail. If the nail form does not include a nail coating, apply an amount of nail coating (e.g., gel) on the nail form with a spatula. In some embodiments, the nail coating is spread evenly in the nail form with a brush dipped in slip solution. In some embodiments, an operation can include applying the nail form to a natural nail. In some embodiments, an operation includes lightly pressing the nail form, including the pre-filled nail coating or newly applied nail coating on the natural nail. The side members directly contact the skin on the side of the nail and the rear member pushes the cuticle down and back on the nail. In some embodiments, an operation can include curing the nail coating with a curing system (e.g., a UV or LED light for 60 seconds with silicone cushion application on the nail form and nail coating to apply pressure). In some embodiments, an operation can include removing the nail form from the natural nail. In some embodiments, an operation can include one or more of trimming, filing, shaping or smoothing the edges of the nail coating. In some embodiments, an operation includes applying a topcoat to the nail coating, if desired, and cure, if necessary.

Figure 7:
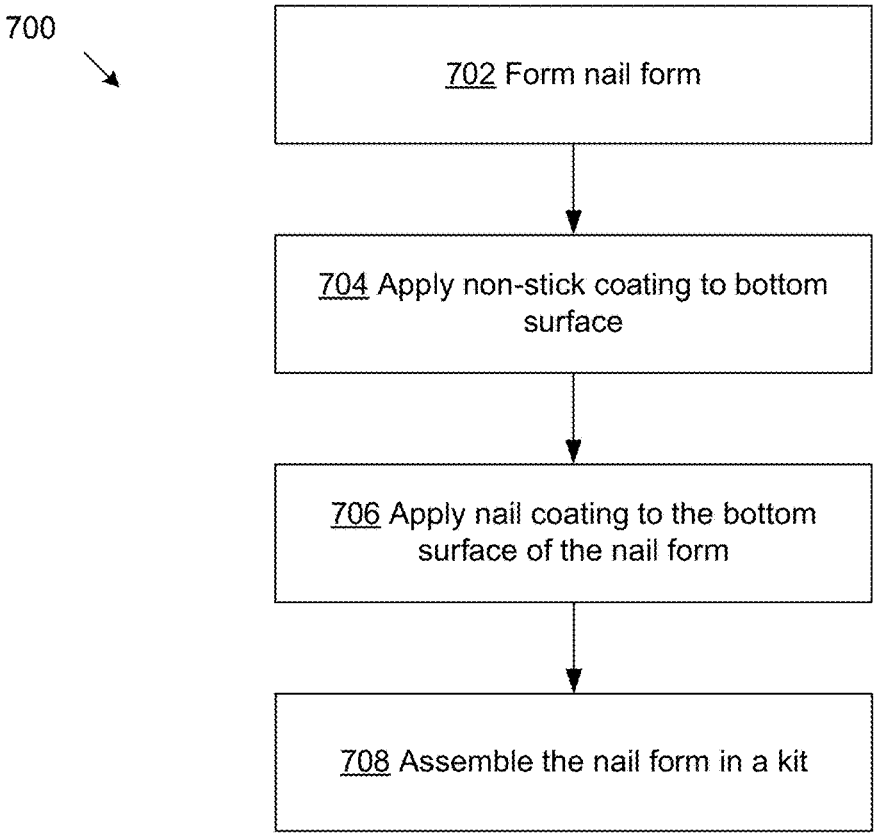
FIG. 7 illustrates an example flow chart of manufacturing a nail form, in accordance with some embodiments.

FIG. 7 illustrates an example flow chart of manufacturing a nail form, in accordance with some embodiments. In some embodiments, various methods of manufacturing may be implemented. In one embodiment, a method of manufacturing includes making a nail system, which include a nail form, including forming two members on the nail form, and forming a rear member on one end of the nail form. In one embodiment, the nail system includes a nail coating. In one embodiment, the nail system includes a curing system. In one embodiment, the nail system includes a kit.

At operation 702 of method 700, a nail form is formed with desired characteristics and including desired material or compositions and configured to receive a nail coating. In some embodiments, the nail form 200 is formed with a mold. In some embodiments, the nail form 200 is formed with a three-dimensional printer. The material can be light-curable material. In some embodiments, the nail form is formed having a bottom surface that forms a cavity. In some embodiments, the bottom surface of the body of the nail form can have curvature(s) between the lateral sides of the body to form a desired apex, which will define an apex of the nail coating when the nail coating is filled in the cavity of the nail form. In some embodiments, the perimeter of the bottom surface (e.g., the inner edge of the lateral sides) can be formed with clean edges to create clean edges of the nail coating on the natural nail.

In some embodiments, side members are formed on the top surface of the nail form in the same operation or different operation. In some embodiments, the side members may be molded into the base as one component. In other embodiments, the side members are separately attached by molding, gluing, or other means. In some embodiments, the nail form can include one or more side members and the side members may be located on the right side or left side of the nail form.

In some embodiments, a rear member is formed at the end of the nail form. In some embodiments, the rear member may be molded into the body as one component. In some embodiments, the rear member can be separately attached by molding, gluing, or other means. In some embodiments, the rear member is in direct contact with a portion of the lateral sides of the body of the nail form. In some embodiments, the rear member may be curved to meet the shape of the nail near the lunula area.

At operation 704, a non-stick coating is applied to at least the bottom surface of the nail form.

At operation 706, a nail coating is applied to the bottom surface of the nail form. In some embodiments, the nail form may be pre-filled with a nail coating in the cavity of the nail form. In some embodiments, the nail coating may include any number of sections, layers and/or compositions. In some embodiments, the nail coating may be light-curable or non-light curable. In some embodiments, the nail coating can be uncured or semi-cured. In some embodiments, the nail coating is disposed in the cavity in a desired form, shape, and thickness. In some embodiments, the exposed side of the pre-applied nail coating may be covered with protective packaging to prevent contact with other items.

At operation 708, the nail form may be assembled in a kit. In some embodiments, the nail form may be a pre-filled nail form having a nail coating therein. In some embodiments, the nail form may be ready to receive a nail coating at the time of application. In some embodiments, the kit may include one or more other items, including a light source, a pressure source, and nail accessories and tools.

Described herein are various embodiments of nail forms, methods of manufacture and methods of use thereof. It is to be understood that the aspects of the disclosure are not limited to the details of construction or process steps set forth in the following description. Aspects of the disclosure can be used to describe other embodiments and of being practiced or being carried out in a variety of ways.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

As used herein, the singular forms "a," "an," and "the" include plural references unless the context clearly indicates otherwise. Thus, for example, reference to "an active ingredient" includes a single active ingredient as well as a mixture of two or more different active ingredients. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances.

As used herein, the term "about" in connection with a measured quantity, refers to the normal variations in that measured quantity as expected by one of ordinary skill in the art in making the measurement and exercising a level of care commensurate with the objective of measurement and the precision of the measuring equipment. In certain embodiments, the term "about" includes the recited number+10%, such that "about 10" would include from 9 to 11.

The term "at least about" in connection with a measured quantity refers to the normal variations in the measured quantity, as expected by one of ordinary skill in the art in making the measurement and exercising a level of care commensurate with the objective of measurement and precisions of the measuring equipment and any quantities higher than that. In certain embodiments, the term "at least about" includes the recited number minus 10% and any quantity that is higher such that "at least about 10" would include 9 and anything greater than 9. This term can also be expressed as "about 10 or more." Similarly, the term "less than about" typically includes the recited number plus 10% and any quantity that is lower such that "less than about 10" would include 11 and anything less than 11. This term can also be expressed as "about 10 or less."

Unless otherwise indicated, all parts and percentages are by weight. Weight percent (wt. %), if not otherwise indicated, is based on an entire composition free of any volatiles, that is, based on dry solids content.

Spatially relative terms, such as "above," "rear," "front," "top," "bottom," "side" and so forth as used herein refer to a relative position of one element with respect to another element. Unless otherwise specified, the spatially relative terms are not intended to be limiting to the absolute orientation, and are intended to encompass different orientations (e.g., rotated 90 degrees, flipped, etc.) of elements in addition to the orientation depicted in the Figures. For example, if elements in the Figures are rotated 180 degrees, elements described as "top" elements can then be considered oriented as "bottom" elements, without deviating from aspects of the disclosure.

The terms "over," "above" "under," "between," and "on" as used herein refer to a relative position of one section, material layer or element with respect to other sections, layers or elements. For example, one section disposed above or over or under another section may be directly in contact with the other section or may have one or more intervening sections. Moreover, one section disposed between two other sections may be directly in contact with the two other sections or may have one or more intervening sections. In contrast, a first section "on" a second section is in direct contact with that second section. Similarly, unless explicitly stated otherwise, one element disposed between two other elements may be in direct contact with the adjacent elements or may have one or more intervening sections, layers or elements.

Although the disclosure herein is with reference to particular embodiments, it is to be understood that these embodiments are merely illustrative of the principles and applications of the invention. It will be apparent to those skilled in the art that various modifications and variations can be made to the compositions and methods without departing from the spirit and scope of the invention. Thus, it is intended that the invention include modifications and variations that are within the scope of the appended claims and their equivalents.

What is claimed is:

1. A nail form for applying a nail coating comprising:

a body comprising:

a top surface;

a bottom surface opposite the top surface, the bottom surface having a first curvature forming a cavity in a shape of a natural nail, wherein an apex of the cavity faces a first direction;

a first lateral side facing the first direction;

a second lateral side facing the first direction, wherein the top surface and the bottom surface extend between the first lateral side and the second lateral side;

a first side member that extends outwardly from the top surface proximate the first lateral side;

a second side member that extends outwardly from the top surface proximate the second lateral side; and a rear member protruding from a rear portion of the first lateral side and the second lateral side, the rear member having a thickness that is less than a thickness of the rear portion of the first lateral side and the second lateral side, wherein the rear member is angled downwardly in the first direction, wherein the rear member is configured to displace a cuticle of the natural nail, and wherein the rear member is configured to align adjacent to the displaced cuticle when the nail form is secured to the natural nail.

2. The nail form of claim 1, wherein the first side member and the second side member extend outwardly at an angle with respect to the top surface.

3. The nail form of claim 1, wherein the first side member and the second side member are configured to push nail folds of a subject away from the natural nail of the subject at an application of the nail form.

4. The nail form of claim 1, wherein an interior surface of the rear member has a second curvature.

5. The nail form of claim 1, wherein the rear member is configured to displace the cuticle concurrent with an application of the nail form on the natural nail.

6. The nail form of claim 1, further comprising:

a guide feature located at the bottom surface, the guide feature to promote a nail coating coupled to the bottom surface to distribute towards the apex of the cavity.

7. The nail form of claim 6, wherein the guide feature comprises a flange that extends inwardly.

8. The nail form of claim 6, wherein the guide feature comprises the first curvature of the bottom surface.

9. The nail form of claim 8, wherein the first curvature of the bottom surface is curved such that a vector normal to a first portion of the bottom surface proximate the first lateral side points at a second portion of the bottom surface opposite the first portion.

10. The nail form of claim 1, further comprising:

a nail coating removably attached to the bottom surface.

11. The nail form of claim 10, wherein the nail coating is a pre-applied nail coating that is pre-applied at manufacture to form a prefilled nail form.

12. The nail form of claim 10, wherein the nail coating comprises a light-curable nail coating.

13. The nail form of claim 12, wherein the light-curable nail coating comprises a semi-cured material prior to an application of the nail form.

14. The nail form of claim 10, wherein the nail coating comprises at least one of a polish, gel, polygel, acrylic gel, and polymer composition.

15. The nail form of claim 1, further comprising:

a non-stick coating disposed on the bottom surface.

16. The nail form of claim 1, further comprising:

a marking visible at the top surface, the marking identifying a size of the nail form.

17. The nail form of claim 1, wherein the first curvature of the bottom surface is along a first axis, the bottom surface having a third curvature along a second axis, the first curvature and the third curvature forming the cavity in the shape of the natural nail.

18. The nail form of claim 1, wherein the body of the nail form is formed of a material that is transparent or semi-transparent.

* * * * *